US012082636B2

(12) United States Patent
Gray

(10) Patent No.: US 12,082,636 B2
(45) **Date of Patent: *Sep. 10, 2024**

(54) WIG AND METHODS OF USE THEREOF

(71) Applicant: Natasha Gray, Cincinnati, OH (US)

(72) Inventor: Natasha Gray, Cincinnati, OH (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/361,788

(22) Filed: Jul. 28, 2023

(65) Prior Publication Data

US 2023/0371631 A1 Nov. 23, 2023

Related U.S. Application Data

(60) Continuation of application No. 17/933,143, filed on Sep. 19, 2022, now Pat. No. 11,751,619, and a division of application No. 17/519,501, filed on Nov. 4, 2021, now Pat. No. 11,497,266.

(60) Provisional application No. 63/253,959, filed on Oct. 8, 2021.

(51) Int. Cl.
*A41G 3/00* (2006.01)

(52) U.S. Cl.
CPC ..... *A41G 3/0033* (2013.01); *A41G 3/0025* (2013.01); *A41G 3/0066* (2013.01); *A41G 3/0075* (2013.01); *A41G 3/005* (2013.01)

(58) Field of Classification Search
CPC ..... A41G 3/00; A41G 3/0008; A41G 3/0033; A41G 3/0041; A41G 3/005; A41G 3/0058; A41G 3/006
See application file for complete search history.

(56) References Cited

U.S. PATENT DOCUMENTS

| | | | | |
|---|---|---|---|---|
| D692,185 | S * | 10/2013 | Gray | D28/92 |
| 9,107,460 | B1 * | 8/2015 | Synn | A41G 3/0016 |
| 2018/0014593 | A1 * | 1/2018 | Suh | A41G 3/0058 |
| 2019/0246728 | A1 * | 8/2019 | Chira | A41G 3/005 |

* cited by examiner

*Primary Examiner* — Rachel R Steitz
(74) *Attorney, Agent, or Firm* — Barry Choobin; Patent 360

(57) ABSTRACT

A method of installing a wig on the head of a wearer, the wig having a top portion that defines an opening corresponding to the wearer's part, the top portion being composed of a fabric and having wig hairs attached to the top portion. Wig clips attach the wig to the wearer's natural hair on the opposing sides of the wearer's part so that the wearer's natural part is exposed. The wearer's natural hair is not disposed over the fabric at the edges of the opening. Alternatively, a leave-out of the wearers natural hair does not cover the wig hair adjacent to the edges of the opening. The wig hair adjacent to the edges of the opening may be tangled or the installer may tease the wig hairs adjacent to the edges of the opening. The invention is also a wig for application of the method.

16 Claims, 23 Drawing Sheets

WIG AND METHODS OF USE THEREOF

CROSS-REFERENCE TO RELATED APPLICATIONS

This application is a continuation of a U.S. patent application Ser. No. 17/933,143 filed on Sep. 19, 2022, which is divisional of a U.S. patent application Ser. No. 17/519,501, filed on Nov. 4, 2021, which is entitled to priority to U.S. Provisional Patent Application 63/174,774 filed Apr. 14, 2021, 63/218,614 filed Jul. 6, 2021, 63/253,959 filed Oct. 8, 2021, and 63/243,386 filed Oct. 11, 2021, all of which are incorporated herein by reference.

FIELD OF INVENTION

The present invention is a method of installing a wig on the head of a wearer, the wig having an opening corresponding to the wearer's natural part that allows the wig to expose the wearer's scalp at the wearer's natural part while hiding the edges of the opening. The invention is also a wig for use with the method of the Invention. The invention is also a method of making the wig and methods of modifying a prior art wig to make the wig.

BACKGROUND

Prior art wigs require the user to wear an artificial parting made of lace or other materials or to wear a section of their hair out at the top of the wig. The Invention is the first to permit the wearer to wear a wig while exposing the wearer's real scalp in their parting area with none of the wearer's hair left out.

Wigs cover or supplement the natural hair of a wearer. Wig hair may be human hair or may be synthetic. The highest quality wigs are composed of human hairs that are attached to a foundation or cap. A full lace wig generally includes a foundation that conforms to the head of the wearer to cover all of the wearer's natural hair. The foundation usually is composed of a lightweight knitted or thermally welded fabric known as 'lace.' If the wig includes a part, the lace is visible at the part and is not readily disguised. See, for example, U.S. Patent Publication 20150013708 by Chamberlain published Jan. 15, 2015, and U.S. Pat. No. 9,027,568 to Lee issued May 12, 2015. For a prior art full lace wig where the lace foundation covers part of the wearer's natural hair, the color of the foundation matches the color of the wearer's scalp. Where the wearer's natural hair is dark and the wearer's scalp is light, the lace foundation is readily visible against the wearer's natural hair.

A prior art U-part wig addresses the problem of the lace of the foundation being visible on the wearer's part. A U-part wig includes a foundation having a U-shaped opening corresponding to the location of the wearer's part. The U-shaped opening is two to four inches wide and exposes a significant portion of the wearer's natural scalp and hair. The U-part wig relies upon the wearer's natural hair to hide the thick edges of the U-shaped opening. See U.S. Patent Publication 2007/0044814 by Belo published Mar. 1, 2007.

The U-part wig has a structural disadvantage compared to other wigs in that the U-shaped opening interrupts the structural integrity of the wig foundation. To support the weight of the wig and to support the elastic forces when the U-shaped wig foundation is stretched over the head of the wearer, the opposing sides of the U-shaped opening must be attached to the user's natural hair using wig clips. Wig clips are sewn using thread to the foundation at anchor locations on the opposing edges of the U-shaped opening. The foundation at the anchor locations is composed of multiple layers of lace or layers of a reinforcing fabric combined with the lace to support the weight of the wig and to support the elastic forces without stretching, fraying, or other failures of the foundation. The thick edges of the foundation at the opposing edges of the U-shaped opening are easily visible.

The two-to-four-inch gap in the prior art U-part wig requires that a substantial portion of the wearer's natural hair, known as a 'leave-out,' is exposed when wearing the wig and that the wearer's natural hair of the leave-out must blend with the hair of the wig. If the wearer's natural hair is of a different texture or color from the hair of the wig, the wearer will not be able to effectively integrate the wearer's hair with the hair of the wig. The wearer will style the leave-out after donning the prior art U-part wig to cover the thick edges of the U-shaped opening. Styling the wearer's natural hair to hide the edges of the U-shaped opening may involve the application of heat, which can damage the wearer's natural hair and scalp. If the texture of the wig is curly or wavy and the wearer's real hair has a different texture, the leave-out will not mimic the texture of the wig. For example, if the wig's texture is 3A and the wearer's texture is 4c, as those terms are used in the wig art, it is extremely difficult to match the textures of the leave-out and the wig. If the textures do not match, it will be obvious to observers that the wearer is wearing a wig.

Because of the thick foundation, prior art U-part wigs use wefts to attach human hair to the foundation corresponding to the top of the wearer's head. A 'weft' is comprised of rows of human or synthetic hairs that are sewn or otherwise attached to an elongated substrate so that the hairs depend on the substrate like a fringe. The use of wefts proximal to the U-shaped opening contributes to the thickness, and hence visibility, of the edges of the prior art U-part wig at the wearer's part.

As described above, when using the usual method of wearing a prior art U-part wig that has a weft at the U-shaped opening, the wearer will wear a section of their own hair out in order to cover the weft and the edge of the U-shaped opening. The wearer will also use their own hair to cover the wig clips, which risk sliding from the underside of the wig. The use of the wearer's own hair has the disadvantages noted above.

An alternative prior art method of wearing a U-part wig that uses wefts around the U-shaped opening is known as the "U-part wig crochet method." The purpose of the U-part wig crochet method is to show the wearer's natural scalp while not leaving out the wearer's natural hair. A prior art U-part wig using wefts does not include a lace cap and the wig hairs of the wefts are accessible from below. In the U-part wig crochet method, the wearer uses a crochet hook to pull wig hairs from the underside of the wig between the top individual wefts and to an edge of the U-shaped opening. The wearer then wraps the wig hairs around the edge of the U-shaped opening in an effort to hide the edge of the U-shaped opening and the adjacent weft. The wearer leaves the wearer's natural scalp exposed between the opposing edges of the U-shaped opening without leaving out the wearer's natural hair. The U-part wig crochet method has the disadvantage that it leaves multiple humps around the user's parting area. These unsightly humps make it obvious that the wearer is wearing a wig. The U-part crochet method of wearing a U-part wig is also time intensive and requires skill to properly use the crochet hook.

A prior art U-part wig with an opening to expose the wearer's scalp may include a lace cap to which wig hairs are attached rather than wefts. The lace is light (nude) in color to correspond to the color of the wearer's scalp but is readily visible against dark hair. To wear a prior art wig that has lace around the opening, the user must wear a section of their own hair out to lay on top of the edge of the wig opening in order to hide the nude color of the lace at the edge and to hide the wig clips that may slide from under the underside of the wig. Also, the lace does not lie flat against the wearer's head because the lace is thin and fine. When a wearer begins to move their head or go outside where there is wind, this lace material pulls away from their scalp, and the wig clips and sticks upward rather than lying flat. The leave-out helps to cover the lace as it moves and a larger leave-out helps to weigh down the lace.

If the lace of the opening is reinforced, the leave-out helps to hide the reinforcement. Due to the issues noted regarding prior methods using wigs with an opening at the top, wearers have mostly worn these wigs with a "leave-out" with the exception of the unnatural results and time-intensive U-part wig crochet method.

A prior art wig by the Inventor herein had a lace top portion and hid the opposing edges of the opening by folding over the edge of the lace and attached hair and sewing the lace and attached hair through the wig clips to the underside of the top portion, covering the wig clips. The thickness of the resulting opposing edges of the opening rendered the opposing edges too bulky to effectively hide without a leave-out, which is the same result as the prior art U-part wigs.

There is a need for a method and wig that permits the wearer to wear their real scalp in their parting area without the need for the wearer to use their own natural hair to cover the top edge of the opening of the wig, that makes the wig hair to appear to grow from the wearer's own real scalp, that is without lumps, that is easy for the average wearer to install, that takes little time, and that is undetectable.

SUMMARY OF THE INVENTION

The following presents a simplified summary of one or more embodiments of the present invention in order to provide a basic understanding of such embodiments. This summary is not an extensive overview of all contemplated embodiments and is intended to neither identify key or critical elements of all embodiments nor delineate the scope of any or all embodiments. Its sole purpose is to present some concepts of one or more embodiments in a simplified form as a prelude to the more detailed description that is presented later.

The wig for the method of the Invention has a foundation that includes a top portion and a side portion. The side portion corresponds to the sides and back of the wearer's head and is conventional. The side portion may include wefts to which rows of wig hairs are attached, as is known in the art. Alternatively, the side portion may include lace and may include wig hairs crocheted or otherwise attached to the lace. The wig hairs may be synthetic or maybe human hair.

The top portion conforms to the top of the wearer's head when the wearer is wearing the wig. The top portion is novel and may include fabric, as defined herein. The fabric may comprise lace, as that term is used in wig-making art. The fabric defines an opening corresponding in location to the wearer's natural part when the wearer is wearing the wig. The opening defines opposing edges of the fabric. The opposing edges of the fabric may be unfinished and unreinforced. The fabric may comprise a single layer.

Wig hairs may be attached to the fabric of the top portion by crocheting. In crocheting, individual wig hairs or a few wig hairs are knotted to the fabric by hand. The knots and the wig hairs extend to the very edges of the opposing edges of the fabric at the opening.

The crocheted wig hairs at the opposing edges of the fabric may be teased or otherwise processed to create a frizzy appearance or tangles in the wig hair at the edges either before or after donning the wig to effectively hide the edges of the fabric while exposing the part in the wearer's natural hair. Because the crocheted wig hairs extend to the opposing edges of the fabric, the edges of the fabric are not readily visible.

The fabric of the top portion is selected to define a net to which the wig hairs are crocheted. A synthetic lace describing a net having openings of 0.3-1.5 mm in diameter and thickness of 0.35-0.45 mm is suitable as the foundation for the top portion. The fabric at the opposing edges may comprise a single layer and may be unfinished and unreinforced, as those terms are defined below.

The wig attaches to the wearer's natural hair adjacent to the wearer's natural part, as described below, using wig clips. The wig clips, and hence the wearer's natural hair, support the weight and elastic forces of the wig. Each wig clip is sewn or glued to the underside of the top portion and is separated from a corresponding edge of the opening by a separation distance of 1 to 4 millimeters, preferably 1.5 to 3 millimeters. If the wig clip is too close to the corresponding edge, then the movement of the fabric may cause the wig clip to be visible at the edge. If the wig clip is too far from the edge, then the fabric at the edge will roll upward when the wig is in place on the wearer's head, making the edge visible. The actual distance selected will depend upon the stiffness of the fabric. For a flexible lace, 1 to 4 millimeters has proven suitable in practice and allows the stiffness of the fabric to maintain the fabric edge in place on the wearer's head.

The fabric of the top portion is selected to conform in color to the wig hair that will be crocheted to the fabric and is not selected to conform in color to the wearer's scalp. Where the wig hair is black, the fabric of the top portion is also selected to be black. In wig art, black wigs generally are available in three color choices—jet black, which includes blue, natural black, which includes brown, and off black, which is between jet black and natural black. Variations exist in these colors, particularly where the wig hair is human hair. The color of the wig hair and the color of the fabric of the top portion are selected to conform as closely as possible, with the goal that a person observing a wearer wearing the wig of the Invention will not perceive a difference between the color of the fabric and the color of the wig hair attached to the fabric.

Applying the method of the Invention to the wig of the Invention causes the opposing edges of the fabric is effectively invisible to an observer and causes the wig hair to appear to be the natural hair of the wearer. In the method of wearing the wig, the wig is installed on the wearer's head so that the opening in the fabric of the top portion is adjacent to the wearer's natural part and reveals the wearer's scalp at the part without a leave-out and without covering the edge of the opening with the wearer's natural hair.

The wearer will first prepare her natural part and her natural hair to receive the wig. The wearer will ensure that her natural part is straight and corresponds in location to the location of the opening of the wig. The wearer will prepare her hair to receive the wig clips, as described below. The wearer will don the wig so that the opposing edges of the opening are adjacent to the wearer's natural part. The wearer will secure the wig clips on the underside of the top portion to the wearer's natural hair on opposing sides of the wearer's natural part. While the best results are achieved when the opposing edges of the opening are immediately adjacent to the part, the Invention also contemplates that the opposing edges may be in a spaced apart relation from the wearer's natural part, for example when the opposing edges are up to two inches from the wearer's natural part.

Because the wig on either side of the opening has a low profile to blend with the wearer's natural part, the wearer's natural hair outside of the part also should have a low profile, while also being able to retain the wig clips. The wearer has options for achieving a low profile and wig clip retention; namely, the teasing option and anchor braid options, discussed below. Alternatively, the wearer may have hair with natural characteristics that may make the hair suitable for attachment to the wig clips without any preparation, such as naturally coarse roots. In addition, the wig clips may be attached to a wearer's unprepared hair for demonstration purposes.

In the teasing option for preparing the wearer's natural hair to receive the wig, the wearer will segregate her natural hair on opposing sides of the wearer's natural part and tease the segregated hair at the root. To tease the hair, the wearer will hold the hair and then will repeatedly comb her natural hair adjacent to the root toward the wearer's scalp. The effect is to create a tangle of the wearer's natural hair on either side of the wearer's part adjacent to the roots of the wearer's natural hair. The wearer will pull her natural hair out of the way, exposing the tangled, teased hair on either side of her natural part. The wearer will place the wig on her head and will engage the wig clips on the opposing edges of the opening with the tangles of the wearer's teased hair immediately adjacent to the wearer's natural part. By engaging the teased hair on either side of the wearer's natural part, the wearer's natural hair retains the wig clips and hence the opposing edges of the opening immediately adjacent to the wearer's natural part.

Rather than teasing her hair to retain the wig clips, the wearer may create anchor braids or small ponytails from her natural hair outside of her natural part. When donning the wig, the wearer may engage the wig clips that are disposed adjacent to the corresponding edges of the fabric with the wearer's natural hair between the wearer's natural part and the anchor braid or the small ponytails. Alternatively, the wearer may engage the wig clips directly with the anchor braids. For some wearers, the step of teasing the wearer's natural hair or creating anchor braids or small ponytails may be unnecessary due to the nature of the wearer's natural hair; for example, where the wearer has naturally thick roots to which to attach the wig.

The method of wearing the wig of the Invention applies to any steps and any order of steps for installing the wig, including steps and orders of steps that do not result in an attractive appearance of the wig of the Invention or that do not result in concealment of the opposing edges of the opening.

As an option, the wearer may create a small 'leave-out' as a styling preference, for example, if the wearer wants to wear a style with sleek, flat roots incompatible with no leave-out. The 'leave-out' of this option is a small fraction of the leave-out of a prior art U-part wig. For example, the small leave-out may be up to 0.5 inches in width, compared to a 2- to 4-inch-wide leave-out of a prior art U-part wig. The leave-out may be located at the wearer's part and located between the wearer's natural part and the wearer's natural hair that is separated and teased adjacent to the wearer's part. The wearer may comb and blend the leave-out with the hair of the wig to further hide the opposing fabric edges of the opening. The small leave-out of this paragraph may be disposed on one side of the wearer's part rather than both sides of the wearer's part.

The wearer may tease, brush, or otherwise process the wig hair attached to the fabric adjacent to the opposing fabric edges to generate tangles to give the wig at that location more volume, to hide the fabric edges, and so that the wig hair mimics the roots of the wearer's natural hair. This option is particularly useful when wearing the wig with no leave-out, as it creates the appearance of natural roots and makes the wig hair appear to grow from the wearer's natural scalp. Alternatively, and as an option, the wig hair may be processed during manufacture to create tangles in the wig hair adjacent to the edges so that when the wearer is wearing the wig the tangled wig hair adjacent to the opening mimics the roots of the wearer's natural hair.

In the first method of making the wig of the Invention, the manufacturer will provide a top portion that may be composed of fabric. The fabric may comprise a single layer of lace. The manufacturer will provide a conventional side portion. The manufacturer will attach the side and top portions. The manufacturer may create an opening in the top portion, by cutting the top portion. The manufacturer may create the opening either before or after assembling the side and top portions. The manufacturer may crochet a plurality of human or synthetic hair to the fabric of the top portion up to the opposing edges of the opening and may sew or adhere a plurality of wig clips to the underside of the top portion adjacent to the opposing edges of the opening. The manufacturer may sew or adhere another wig clip at the back end of the opening. The manufacturer may attach conventional wig combs to secure the side portion of the foundation to the wearer's hair. The manufacturer may attach wefts of human hair to the side portion of the foundation, completing the wig. Alternatively, the side portions may be composed of a fabric and the wig hairs may be crocheted to the fabric. The manufacturer will not fold over the fabric and attached wig hair at the edge of the opening to cover the wig clips and will not sew folded fabric and attached wig hair through the wig clips.

In the second method of making the wig of the Invention, a manufacturer may modify an existing completed wig, as defined herein, to produce the wig of the Invention as described above. As used herein, the 'manufacturer' may be a wig supplier but also may be a social media influencer, the wearer, or any other person. For example, a social media influencer who demonstrates modifying a completed wig to become the wig of the Invention is a 'manufacturer.' As a first alternative, the manufacturer may start with a wig that has no opening, but that is otherwise complete. The foundation of the wig may include a top portion composed of fabric with human or synthetic hair crocheted to the top portion. The manufacturer may cut the fabric of the top portion from front to back at a location corresponding to the part of the wearer's natural hair when the wearer is wearing the wig, with the cut in the fabric defining an opening. As described above, the manufacturer may sew or adhere a plurality of wig clips to the underside of the top portion on either edge of the opening and may attach a wig clip to the underside of the top portion at the back end of the opening. The result is the wig of the Invention.

As a second alternative, the manufacturer may start with a completed wig that has some but not all of the features of the wig of the Invention. For example, a completed wig has an opening but does not include wig clips on either side of the opening. The manufacturer, who may be the wearer or a social media influencer, may install the wig clips as described above. The result is the wig of the Invention.

As a third alternative, the manufacturer may start with a completed wig that has wig clips installed on either side of a location where the opening will be cut but that does not yet include an opening. The manufacturer, who may be the wearer or a social media influencer, may cut the opening. The result is the wig of the Invention.

Unlike the prior art, the method and wig of the Invention do not require that the installer provide a leave-out of the wearer's natural hair at the wearer's part to disguise the edges of the opening, and the wig hairs adjacent to the opening appear to grow from the wearer's scalp.

BRIEF DESCRIPTION OF THE DRAWINGS

The accompanying figures, which are incorporated herein, form part of the specification and illustrate embodiments of the present invention. Together with the description, the figures further explain the principles of the present invention and enable a person skilled in the relevant arts to make and use the invention.

DETAILED DESCRIPTION

Figure 1:
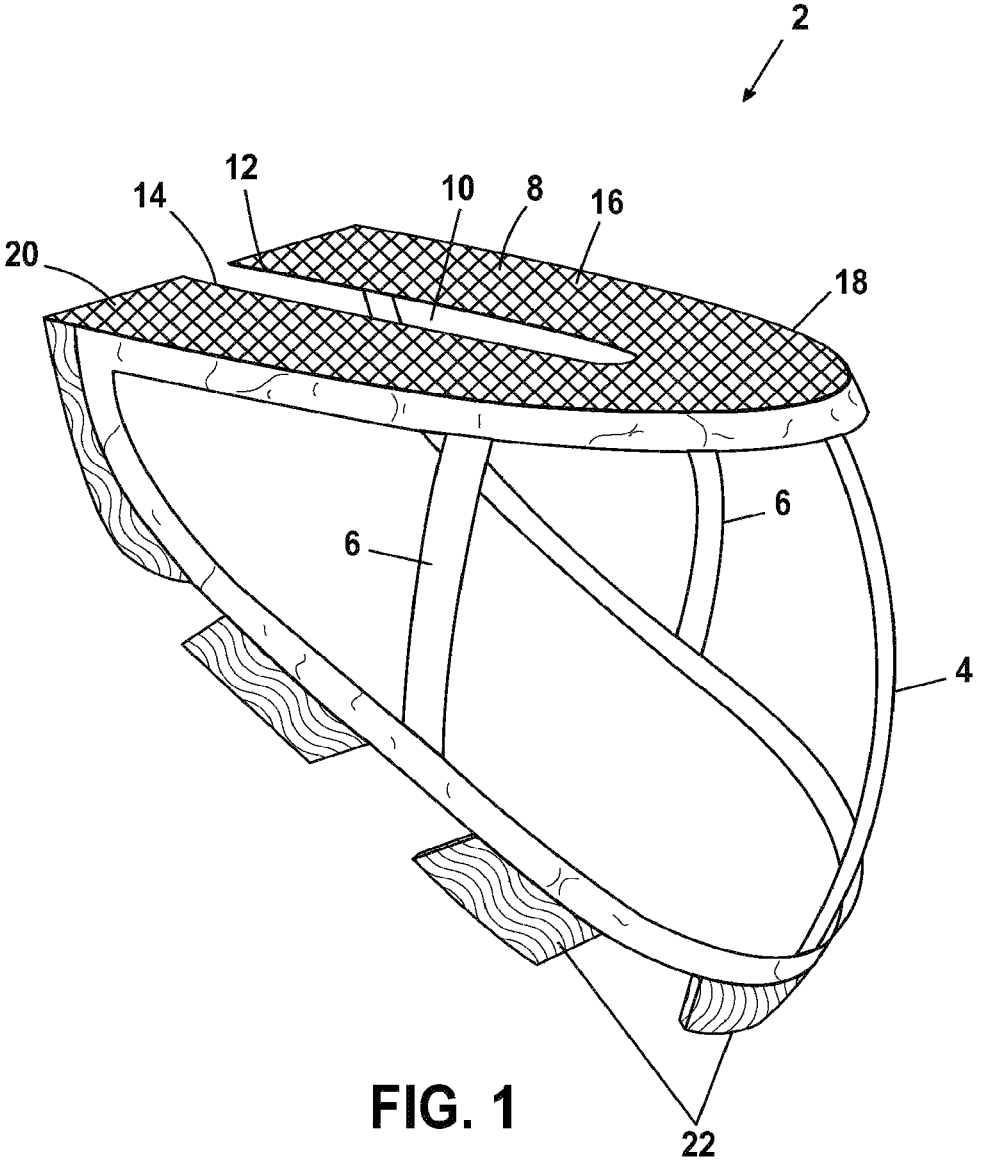
FIG. 1 is a perspective view of the wig foundation.

Subject matter will now be described more fully hereinafter with reference to the accompanying drawings, which form a part hereof, and which show, by way of illustration, specific exemplary embodiments. Subject matter may, however, be embodied in a variety of different forms and, therefore, covered or claimed subject matter is intended to be construed as not being limited to any exemplary embodiments set forth herein; exemplary embodiments are provided merely to be illustrative. Likewise, a reasonably broad scope for claimed or covered subject matter is intended. Among other things, for example, the subject matter may be embodied as methods, devices, components, or systems. The following detailed description is, therefore, not intended to be taken in a limiting sense.

The word "exemplary" is used herein to mean "serving as an example, instance, or illustration." Any embodiment described herein as "exemplary" is not necessarily to be construed as preferred or advantageous over other embodiments. Likewise, the term "embodiments of the present invention" does not require that all embodiments of the invention include the discussed feature, advantage, or mode of operation.

The terminology used herein is for the purpose of describing particular embodiments only and is not intended to be limiting to embodiments of the invention. As used herein, the singular forms "a", "an" and "the" are intended to include the plural forms as well, unless the context clearly indicates otherwise. It will be further understood that the terms "comprises", "comprising,", "includes" and/or "including", when used herein, specify the presence of stated features, integers, steps, operations, elements, and/or components, but do not preclude the presence or addition of one or more other features, integers, steps, operations, elements, components, and/or groups thereof.

The following detailed description includes the best currently contemplated mode or modes of carrying out exemplary embodiments of the invention. The description is not to be taken in a limiting sense but is made merely for the purpose of illustrating the general principles of the invention since the scope of the invention will be best defined by the allowed claims of any resulting patent.

Terms

As used in this document, the following terms have the following meanings: Adhesive—A glue or other agent that will adhere to a fabric and that also will adhere to a wig clip. The adhesive may define a two-sided tape. The two-sided tape may be a differential tape and may include a first adhesive on the first end that will adhere to the wig clip and a second adhesive on the opposite second end that will adhere to the fabric.

Anchor braid—An anchor braid is a braid of the wearer's natural hair comprising two, three, or four groups of hairs that are braided together in a row close to the scalp. A wig clip may be attached to anchor braids to attach the wig to the wearer. Alternatively, the wig clip may be attached to the wearer's natural hair between the wearer's natural part and the anchor braid.

Anchor location—In a prior art U-part wig, a robust location on the foundation to which wig clips are sewn adjacent to the U-shaped opening.

Cap or Foundation—a substrate to which wig hairs or wefts are attached and that supports the wig hairs or wefts. The cap or foundation may be composed of a fabric and is attached to the natural hair of the wearer.

Completed wig—As used herein and relating to modifying an existing wig to define the wig of the Invention, a 'completed wig' is a prior art wig that is otherwise ready for wear but that does not include an opening or wig clips attached on either side of the opening. A 'completed wig' is also a wig that does not include the opening, but does include wig clips along the opposing edges of where the opening will be when the opening is cut. A 'completed wig' also is a wig that includes the opening but does not include the wig clips disposed on either side of the opening.

Crochet or ventilate—the labor-intensive process of attaching individual human or synthetic hairs to a fabric wig foundation by passing a specialized wig crochet hook through the foundation, pulling the human hair through the foundation, and knotting the wig hair to the foundation. Wig hairs are attached to the foundation by crocheting (ventilating) one hair at a time or a few hairs at a time.

Crocheted hair—wig hair, usually human hair, that has been attached to a foundation by crocheting.

Fabric—means any sheet material that is adequately flexible to conform to a wearer's head, including a woven, knitted, or fused stranded fabric, polyurethane or other synthetic sheet, or any other suitable material. A fabric may have a single layer. The fabric also may have two or more layers.

Fraying and unraveling—a woven fabric, such as a plain weave, satin, or twill, will come apart when the woven threads become separated at an edge. A knitted fabric will unravel, or come apart, from an end.

Full lace wig—a wig including a lace foundation that covers the wearer's natural hair, including the natural part of a wearer.

Installing—in relation to installing a wig means installing the wig on the head of the wearer by the wearer and also means installing the wig on the head of the wearer by another person.

Lace—a woven, knitted, or fused fabric used for wig foundations. The lace usually is light in weight and low in strength.

Leave-out—For a prior art U-part wig, a 'leave-out' is the portion of the wearer's natural hair that is exposed by the U-shaped opening of the prior art wig and is generally two to four inches wide. The ends of the wearer's natural hair of the leave-out are not covered by the wig and are disposed over the wig hair at the edges of the U-shaped opening. The wearer must blend the wearer's natural hair of the leave-out with the wig hair. Differences in color, texture, or length can be readily apparent. The wearer of the wig of the Invention may optionally elect to create a narrow leave-out, for example of up to 0.5 inches in width as a style choice or to further hide the opposing edges of the opening.

Manufacturer—A maker of a wig. The term 'manufacturer' also means any other person, such as a wearer of a wig or a social media influencer, who takes any of the steps of manufacturing the wig of the invention, including steps to modify a completed wig, as that term is defined, to become the wig of the Invention. For example, a social media influencer who cuts a completed wig to define an opening and adds wig clips adjacent to the opening is a manufacturer. The social media influencer who cuts an opening in a completed wig having wig clips disposed on opposing locations about which the opening is to be cut is also a manufacturer. The social media influencer who adds wig clips on either side of an opening defined by an otherwise completed wig is a manufacturer.

Natural hair—hair growing from the head of the wearer of the wig.

Natural part—The wearer's natural part is the portion of the wearer's scalp that is exposed when the wearer combs or brushes the wearer's natural hair in opposing directions.

Non-fraying and non-unraveling in ordinary and expected usage—a fabric that does not fray or unravel when worn and stored as wigs are usually worn and stored.

Opening—an opening communicating through the fabric top portion of the wig that corresponds in location to the natural part of a wearer when the wearer is wearing the wig. The opening may be defined by a single cut through the fabric of the top portion of the wig; alternatively, the opening may have any width or shape provided that the top portion will conform to the head of an adult human being and so that the edges of the opening may be disposed adjacent to the opposing sides of the wearer's natural part when the wig is installed on the head of the wearer.

Reinforce—to add structure that strengthens the edges of fabric at the opening. Reinforcement includes finishing and also includes adding layers of the fabric or of another fabric at the edge. A fabric edge is unreinforced when no structure is added to the fabric edge to support a structural load or to prevent fraying or unraveling of the fabric.

Unfinished—With respect to the wig of the Invention, the opposing edges of the opening may be 'unfinished' when the edges are not modified to prevent fraying or unraveling of the edge or to reinforce the edge using any of the techniques for finishing an edge known in the sewing art, including a serged finish, a chemical sealant finish, a stitched edge finish, a zigzag seam, a hemmed fell seam finish, a bound edge finish, a scalloped edge finish, an overcast finish, a double-stitched finish, a piped edge, a heated edge finish and any other technique known in the sewing art for finishing an edge of a fabric.

Teasing—Teasing hair means back-combing the hair repeatedly towards the scalp, causing the hair to tangle and knot. When a person teases the hair adjacent to her scalp, the resulting tangles can engage and retain the wig clips of the Invention adjacent to the wearer's part.

U-part wig—a prior art wig that exposes the wearer's natural part and that exposes the wearer's hair around the part. The cap or foundation of a U-part wig includes a U-shaped opening that is two to four inches wide and that corresponds in location to a part in the wearer's natural hair. The prior art U-part wig requires a thick, reinforced edge at the part and requires the wearer's natural hair to be arranged in a leave-out over the part to hide the thick edges of the wig.

Weft—a row or fringe of human or synthetic hair that is attached, as by sewing, to a substrate. A weft is sometimes described as a portion of a hula skirt. By attaching a weft to a cap or foundation, a wig maker can attach a large number of hairs relatively quickly and without resorting to labor-intensive crocheting. The term 'weft' in wig-making art is different from 'weft' as applied to a woven fabric.

Wig clip—a clip that is attached to the wig foundation to attach the wig foundation to the wearer's natural hair. The term 'wig clip' in this document also means 'wig comb,' as both of those terms are used in the wig art unless the context specifically requires otherwise. In a prior art U-part wig, each wig clip is sewn to a robust and thick anchor location on the foundation on either side of the part. The wig clips of the Invention may be sewn with or without adhesive to the top portion, which may comprise a single layer or two or more layers of fabric.

Wig hair—means one or more strands that are or that will be attached to a wig foundation to mimic or represent human hair. The wig hair may be composed of human hair or may be synthetic. The synthetic hair may be composed of any material to mimic human hair, including thread.

The wig 2 of the Invention includes a foundation 4, shown by FIG. 1. The foundation 4 includes a side portion 6 configured to conform to the sides and back of the head of the wearer. The foundation 4 also includes a top portion 8 configured to conform to the top of the head of the wearer. The top portion 8 defines an opening 10 that communicates through the top portion 8. The opening 10 is located to correspond to the natural part 64 in the natural hair 68 of the wearer when the wearer is wearing the wig 2.

From FIG. 1, the opening 10 defines opposing edges 12, 14 in the top portion 8. The top portion 8 may be composed of a fabric 16, which may comprise a single layer 18 of fabric 16. The fabric 16 at the opposing edges 12 and 14 may be unfinished and unreinforced, as defined herein. The fabric 16 may be a lace 20, as that term is used in wig-making art. Tabs 22 allow the wearer to grip the foundation 4 when donning the wig 2 without gripping the wig hair 24 or the foundation 4.

Figure 2:
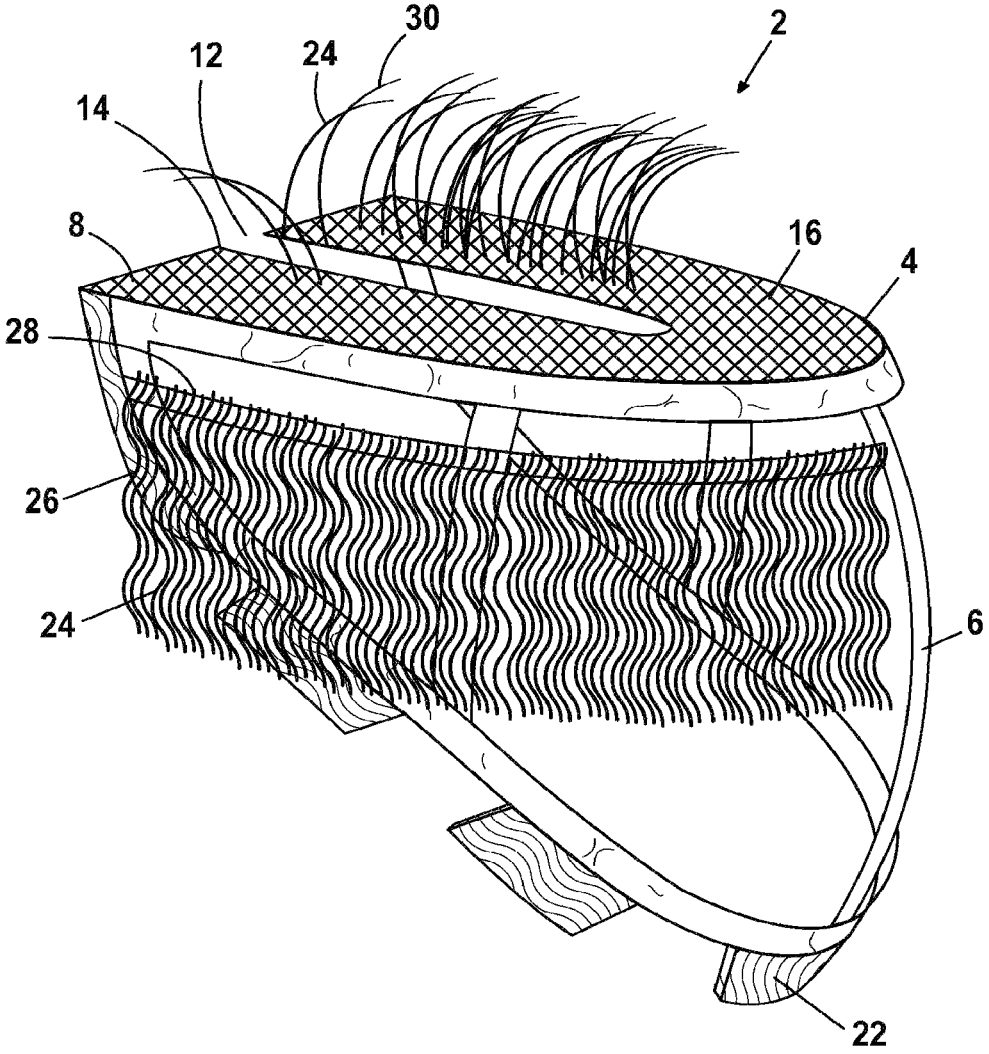
FIG. 2 is a perspective view of the foundation with weft and crocheted hairs installed.

FIG. 2 shows foundation 4 with some of the wig hairs 24, which may be human hairs, attached to the foundation 4. A plurality of wefts 26 may be attached to the side portion 6. Each weft 26 includes multiple wig hairs 24 that are attached to a substrate 28, as by sewing. The substrate 28 is attached to the side portion 6, which supports the substrate and the wig hair 24. Wefts 26 are attached in rows to the side portion 6, with a space between each adjacent pair of wefts 26. The use of wefts 26 allows a large number of wig hairs 24 to be attached to the foundation 4 while allowing air movement through the wefts 26 to the scalp of the wearer. Alternatively, wig hairs 24 may be crocheted to the side portion 6.

FIG. 2 also shows individual wig hairs 24 or small numbers of wig hairs 24, which may be human hairs, that are crocheted to the fabric 16 of the top portion 8. The crocheted hairs 30 are hand-tied by a wig maker to fabric 16 using a crochet hook. The crocheted hairs 30 are crocheted across the entire top portion 8 up to and including the opposing edges 12 and 14.

From FIG. 2, the wig hairs 24 have a wig hair 24 color and the fabric 16 has a fabric 16 color. The fabric 16 color is selected to have a hue, saturation, and intensity so that the fabric 16 color corresponds to the wig hair 24 color adequately well that an observer will not notice a difference between the wig hair 24 color and the fabric 16 color. For wig 2 having black wig hair 24, the fabric 16 will also be black. Black wigs 2 generally are available with a wig hair color of jet black, true black, or natural black. For such wigs 2, fabric 16 will conform to jet black, true black, and natural black. This color selection for fabric 16 differs from prior art wigs, in which the fabric 16 color is selected to be a very light 'nude' color to match the wearer's scalp color and not to match the wig hair 24 color.

Figure 3:
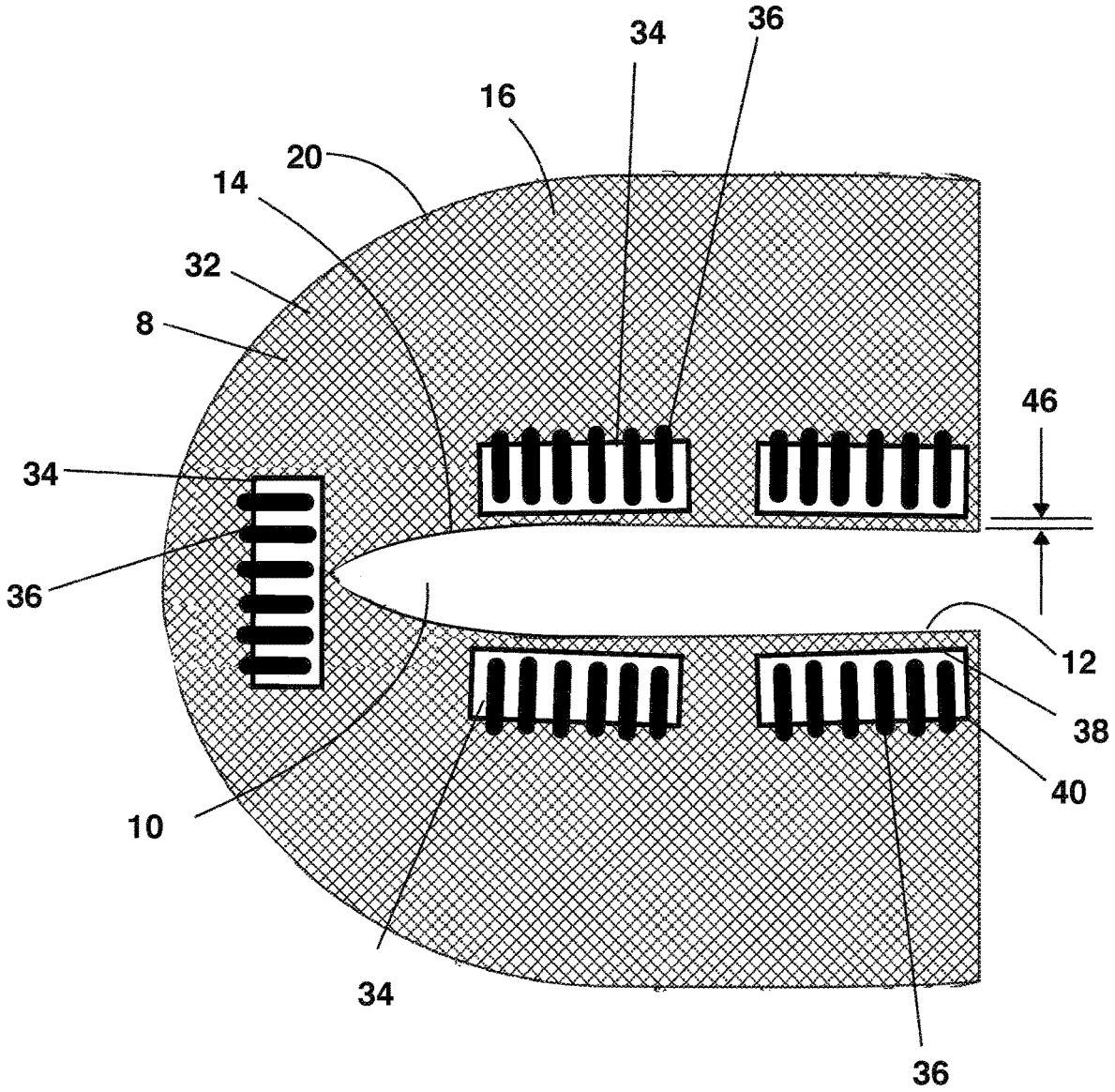
FIG. 3 is a view of the underside of the foundation showing wig clips.

FIG. 3 shows the underside 32 of the top portion 8 with the side portion 6 removed for clarity. The fabric 16 of the top portion 8 defines the opening 10 communicating through the fabric 16. The fabric 16 may be a lace 20 and may consist of a single layer of the fabric 16. The opening 10 defines two opposing edges 12 and 14 of the fabric 16. The two opposing edges 12 and 14 may be unfinished and are unreinforced. The location of the opening 10 corresponds to the part of the wearer's natural hair when the wearer is wearing the wig 2.

Figure 4:
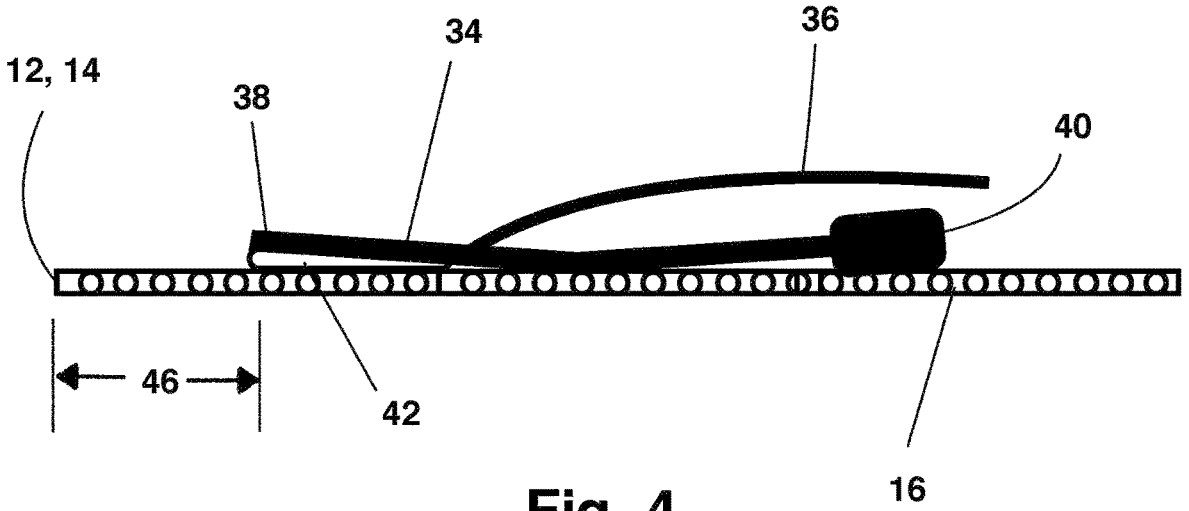
FIG. 4 is a detailed end view of a wig clip attached to a single layer of fabric.
Figure 5:
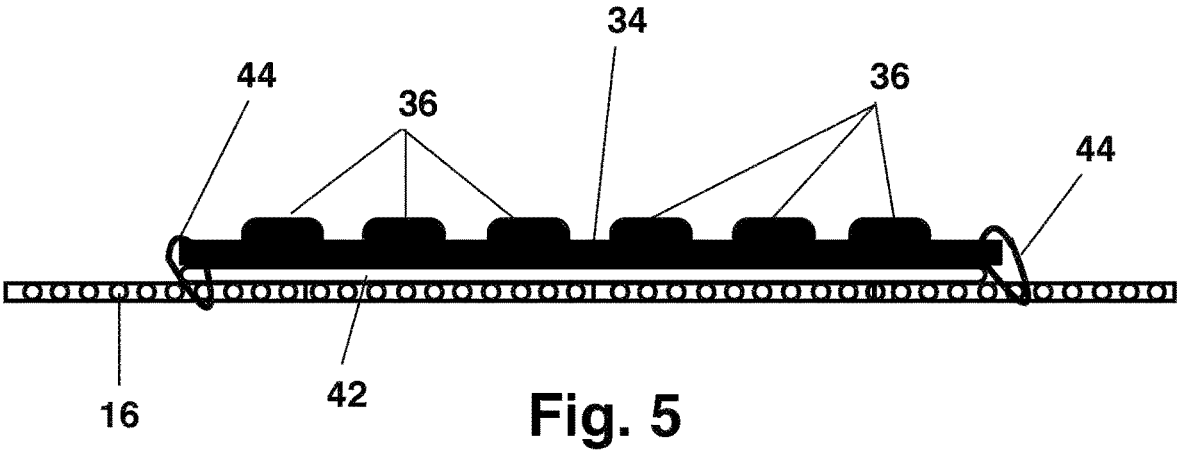
FIG. 5 is a detailed side view of a wig clip attached to a single layer of fabric.

From FIG. 3, and as shown in more detail relating to FIGS. 4 and 5, a plurality of wig clips 34 are attached to the underside 32 of the top portion 8 on the opposing edges 12, 14 of the opening 10. The wig clips 34 include a plurality of spring-loaded, hair-engaging teeth 36, as are known in the art, to attach the underside 32 of the top portion 8 to the wearer's natural hair when the wearer is wearing the wig 2. The wig clips 34 support the weight of the wig 2 and the elastic forces resulting from the wearer stretching the top portion 8 and side portion 6 to conform to the wearer's head when the wearer is donning the wig 2.

As shown by FIG. 3 and by the detailed end view of FIG. 4, each of the wig clips 34 defines a first end 38 and a second end 40. The first end 38 of each wig clip 34 is attached to fabric 16 proximal to the opening 10. Each wig clip 34 defines spring-loaded, hair-gripping teeth 36 that emerge from the wig clip 34 adjacent to the first end 38. The second end 40 of the wig clip 34 is disposed farther from the opening 10 than the first end 38.

From FIGS. 4 and 5, the first end 38 of each wig clip 34 is attached to fabric 16 by an adhesive 42 or by sewn threads 44. Unlike the prior art, the top portion 8 of the foundation may be unreinforced at an anchor location to support threads 44 sewing the wig clip 34 to the fabric 16. The adhesives 42 that are believed to be suitable include cyanoacrylate adhesives, polyurethane adhesives, urethane adhesives, and epoxy adhesives.

As shown by FIGS. 3 and 4, the first end 38 of the wig clip 34 is set back from the corresponding opposing edge 12, 14 of the top portion 8 by a separation distance 46. If the separation distance 46 is too small, deformation of the fabric 16 at the opposing edges 12, 14 may expose the wig clip 34. If the separation distance 46 is too large, fabric 16 at the opposing edges 12 and 14 may curl, exposing the wig clip 34. A separation distance of 1 to 4 millimeters is believed to be suitable, with a separation distance of 1.5 to 3 millimeters preferred.

Figure 6:
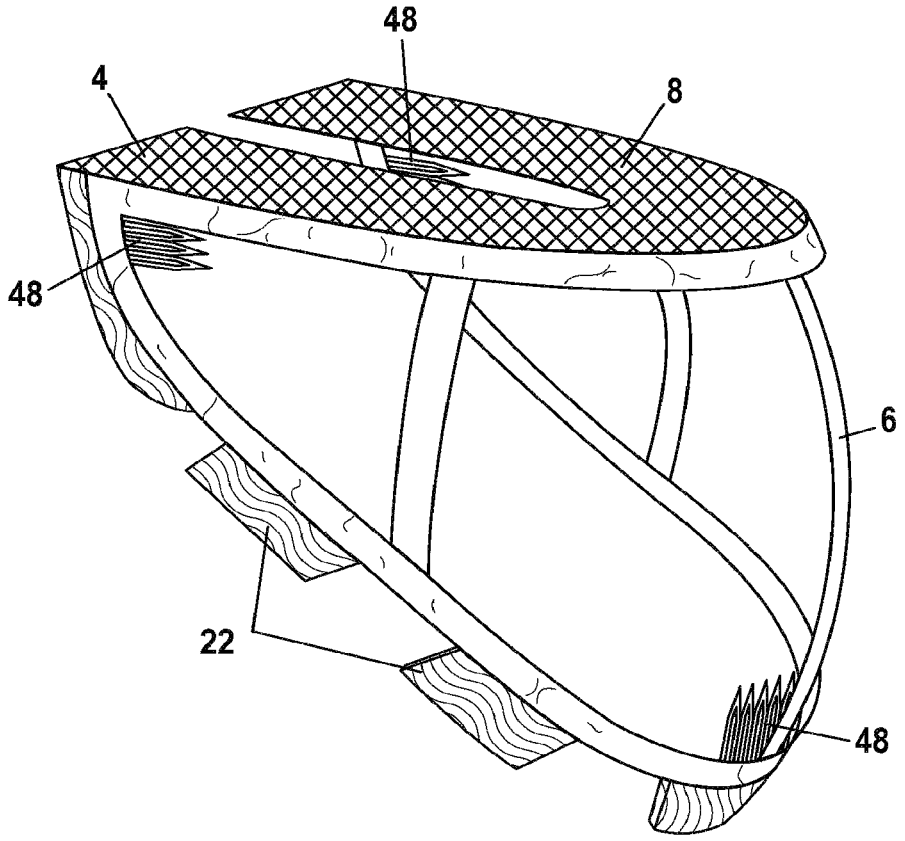
FIG. 6 is a perspective view of the foundation showing wig combs.

FIG. 6 shows the foundation 4 including wig combs 48, as are known in the art, to attach the foundation 4 to the wearer's natural hair 68. Wig combs 48 and wig clips 34 may be used interchangeably and in this document, the term wig clips 34 includes wig combs 48, including wig combs 48 for attaching the opposing edges 12, 14 to the wearer's natural hair 68.

FIGS. 7A through 11 illustrate a method of wearing the wig 2 of the Invention and also illustrate variations of the method. FIGS. 7A through 11 also apply to persons, such as social media influencers or wig manufacturers, that instruct a wearer on how to wear the wig 2 of the Invention.

FIGS. 7A, 7B, 7C, and 7D illustrate methods of wearing the wig involving alternative preparation of the wearer's natural hair 68 to receive the wig 2 and alternative attachments of the wig 2 to the wearer's natural hair 68. For each of the methods of FIGS. 7A, 7B, 7C, and 7D, the wig hair 24 at the edges 12, 14 is either provided to the wearer in a processed state so that the wig hair 24 has a frizzy, tangled texture or the wearer will tease the wig hair at the edges 12, 14 to create the frizzy, tangled texture. The frizzy, tangled texture of the wig hair 24 at the edges 12, 14 causes the wig hair to appear to grow from the wearer's scalp 68 and hides the edges 12, 14.

Figure 7A:
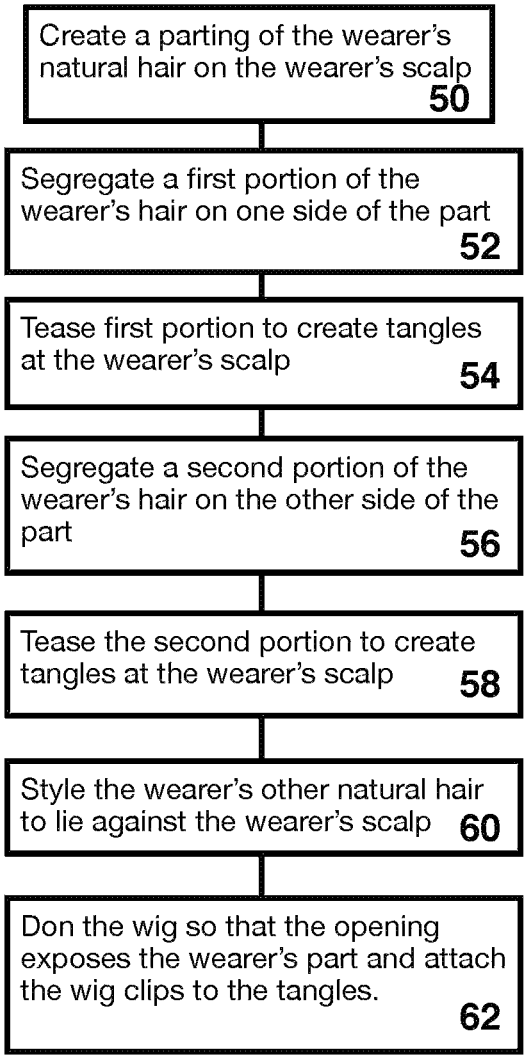
FIG. 7A is a flow chart of the first method for wearing the wig.
Figure 8A:
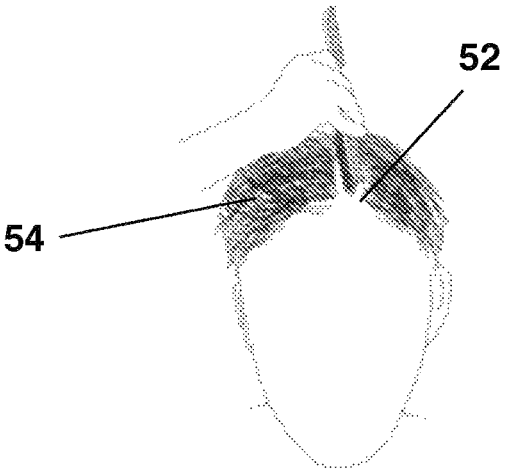
FIG. 8A shows a wearer preparing the wearer's part.
Figure 8B:
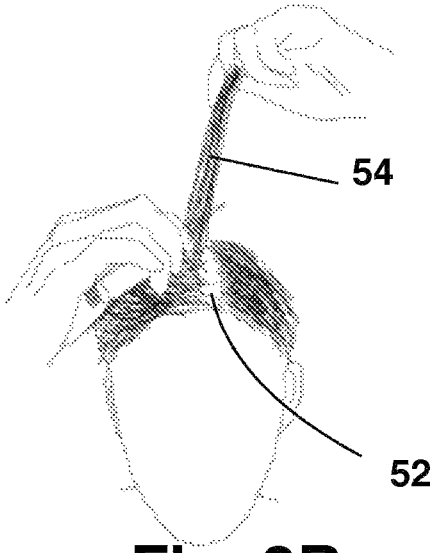
FIG. 8B shows a wearer teasing her hair on one side of her part.
Figure 8C:
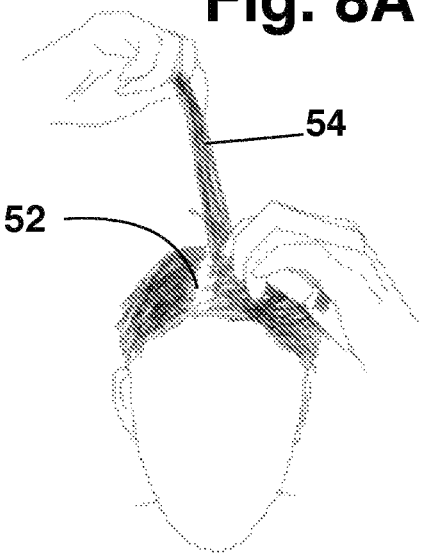
FIG. 8C shows a wearer teasing her hair on the other side of her part.
Figure 8D:
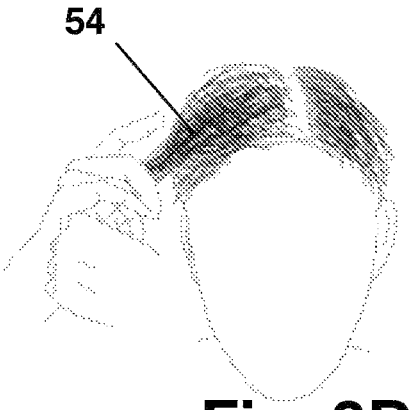
FIG. 8D shows a wearer pulling her hair out of the way of the wig.
Figure 8E:
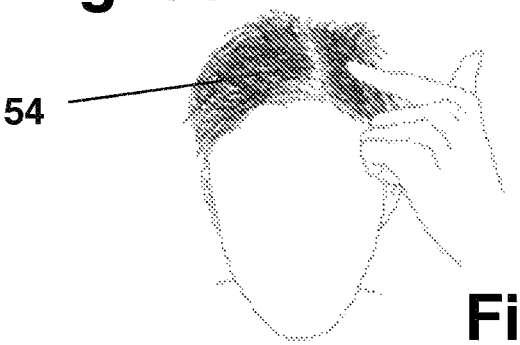
FIG. 8E shows the wearer's prepared hair.

As shown by the flowchart of FIG. 7A, steps 50 through 60, and FIGS. 8A through 8E, the wearer may prepare the wearer's natural hair 54 to receive the wig 2. From step 50 and FIG. 8A, the wearer will first straighten and define her natural part 64. From step 52 and FIG. 8B, the wearer may segregate the first portion of her hair 68 on one side of her natural part 64. From step 54 and FIG. 8B, the wearer may tease the first portion of her natural hair 68 at the roots to create a tangle of her hair 68 at the roots adjacent to part 64. From steps 56 and 58 and FIG. 8C, the wearer may repeat the process of segregating a second portion of her hair 68 and teasing the segregated hair 68 on the other side of her part 64. The wearer may move her hair 68 out of the way and against her scalp 70 from step 60 and FIG. 8D. FIG. 8E shows the wearer's hair 68 prepared and ready for wig 2, with the teased hair 68 on either side of part 64.

Figure 9A:
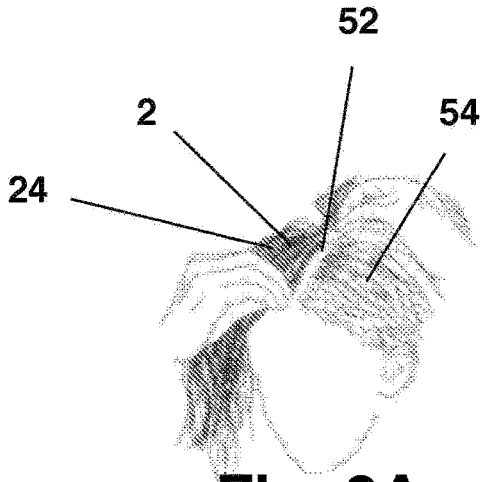
FIG. 9A shows the wearer attaching the wig to one side of the wearer's part.
Figure 9B:
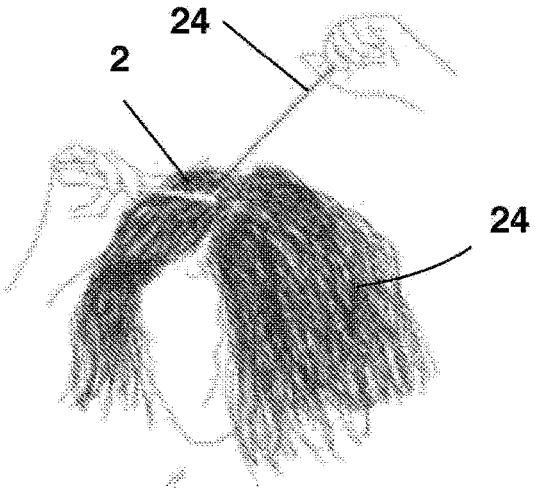
FIG. 9B shows the wearer teasing the wig hair at the part.
Figure 9C:
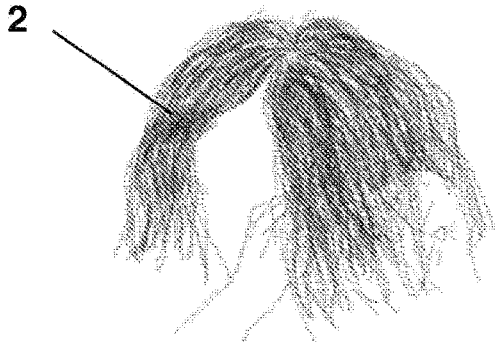
FIG. 9C shows the wearer attaching the wig combs.
Figure 9D:
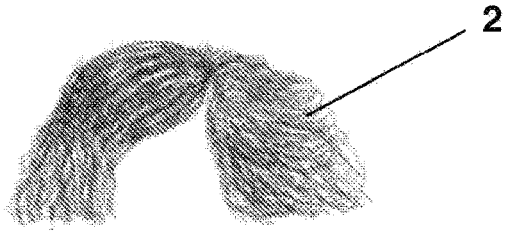
FIG. 9D shows the wig installed according to the method of the Invention.

Step 62 and FIGS. 9A through 9E relate to the donning of the wig 2. From step 62 and FIG. 9A, the wearer may place an edge 12, 14 of the top portion 8 adjacent to her natural part 64. The wearer may attach the wig clip 34 to the tangle of the teased hair 68 on that side of part 64. The wearer may repeat the process for the other edge 12, 14 of the top portion 8 and may attach the wig clips 34 to the tangled hair 68 of the other side of the natural part 64. From FIG. 9B, the wearer may tease the roots of the wig hair 24 at the edges 12, 14 to make the wig hair 24 fuller at that location and to blend the wig hair 24 at the edges 12, 14 with the wearer's natural hair 68 at the part 64. The wearer may complete the installation by attaching the wig combs 48 (FIG. 9C), The finished installation is shown by FIG. 9D.

Figure 9E:
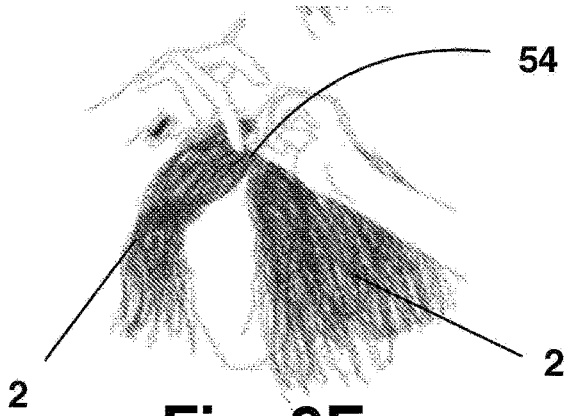
FIG. 9E shows a wearer blending a leave-out with the wig hair.

FIG. 9E illustrates a variation in the method of wearing the wig 2. The wearer optionally may select to create a narrow 'leave-out,' as defined above. To create a narrow leave-out using the wig 2 of the Invention, the wearer will segregate a small amount of her natural hair 68 between the first and second portions of her natural hair 68 segregated as shown by FIGS. 9B and 9C and shown as steps 52-56. When the wig 2 is otherwise installed, the wearer will comb and blend her natural hair 68 of the leave-out with the wig hair 24 to disguise the edges 12, 14 of the top portion 8 of the wig 2. The other steps of this option are described above in the flow chart of FIG. 7.

Figure 7B:
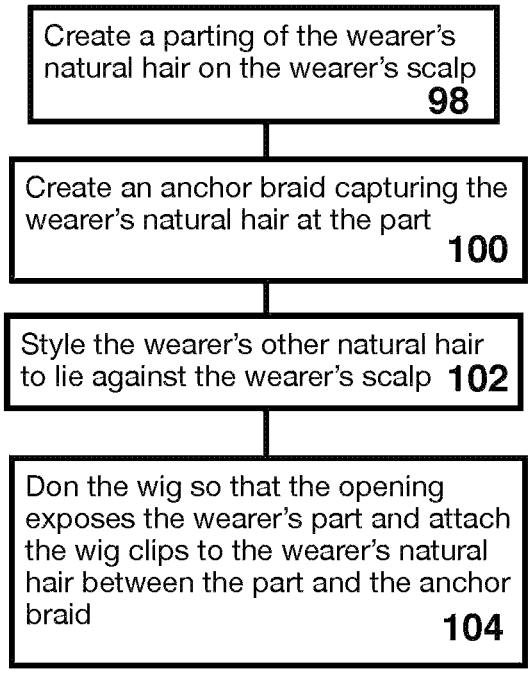
FIG. 7B is a flow chart of a second method of wearing the wig.
Figure 10A:
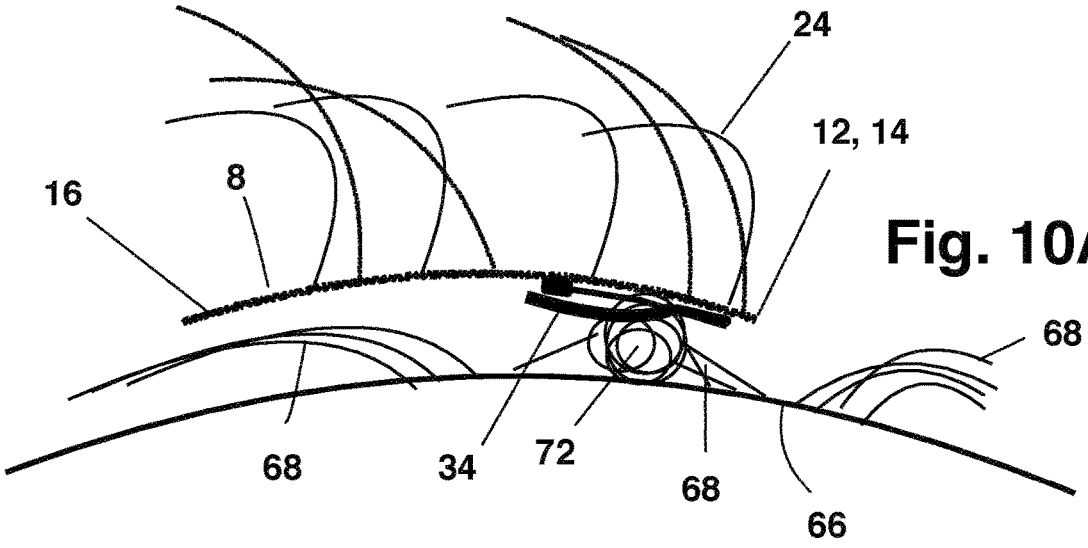
FIG. 10A shows an anchor braid separated from the wearer's part with a wig clip attached to the anchor braid.
Figure 10B:
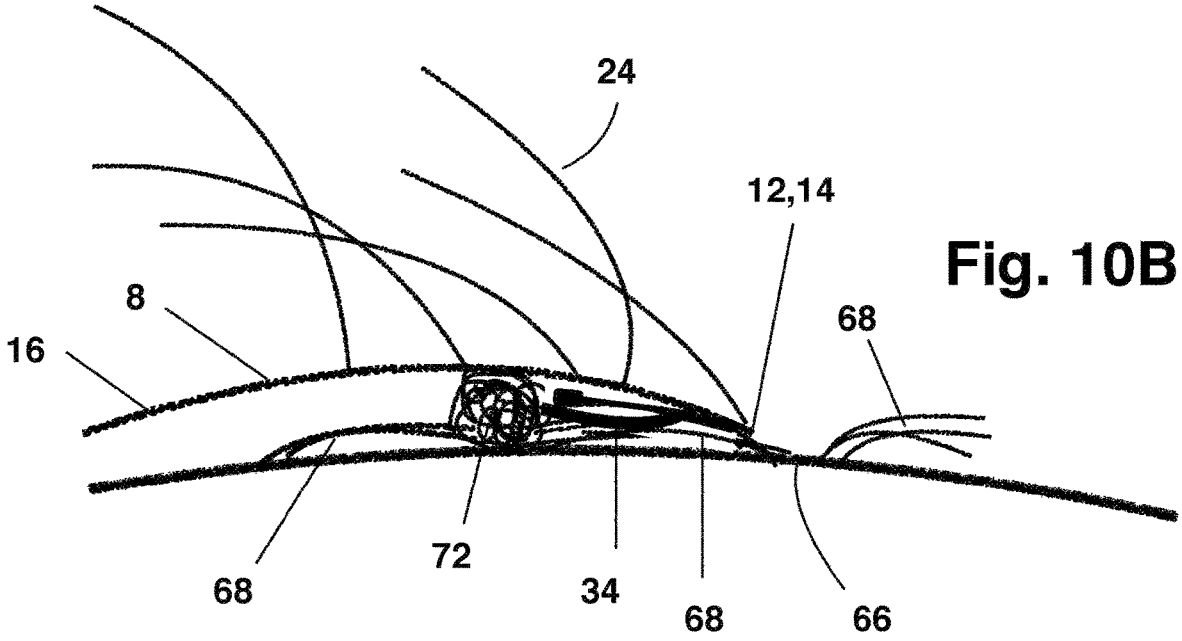
FIG. 10B shows the wig clip attached to natural hairs adjacent to the part and stopped by the anchor braid.

FIG. 7B and FIG. 10B illustrates a second method of preparing the wearer's natural hair 68 to receive the wig 2. The wearer first creates a part 64 of her natural hair 68. The wearer then creates anchor braids 72 on the opposing sides of the wearer's part 64 so that the anchor braids 72 capture the natural hair 68 from the wearer's part 64. The wearer then dons the wig 2, securing the wig clips 34 to the wearer's natural hair 68 stretched between the natural part 64 and the anchor braid 72. The anchor braid 72 acts as a stop preventing lateral movement of the wig 2 due to the weight of the wig 2. FIG. 10B shows the wig 2 in place on the wearer's head with the wig clip 34 engaging the wearer's hair 68. The alternative method of FIGS. 7B and 10B are particularly useful for attaching a wig 2 having straight wig hair 24 because the straight wig hair 24 of the wig 2 blends with the straight hair 68 of the wearer at the wearer's part 64.

Figure 7C:
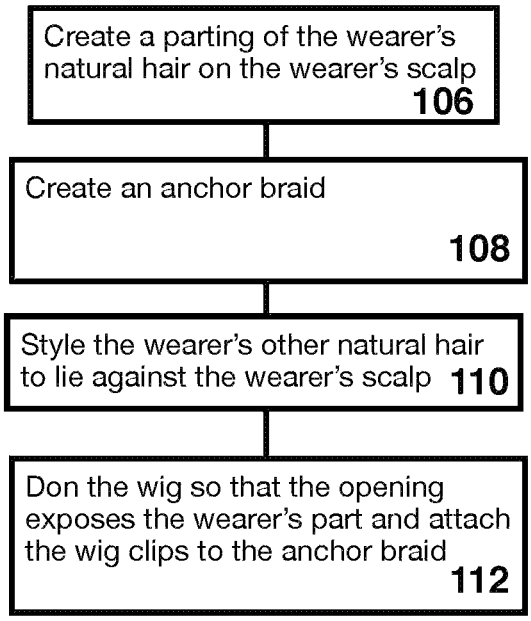
FIG. 7C is a flow chart of a third method of wearing the wig.

FIG. 7C and FIG. 10A illustrates a third method of preparing the wearer's hair 68 and attaching the wig 2 to the wearer's natural hair 68. From FIG. 7C, the wearer creates a part 64 in her natural hair 68 and creates an anchor braid 72 in a spaced-apart relation to the part 64. The wearer dons the wig 2 and attached the wig clips 34 to the anchor braid 72 itself. FIG. 10A shows the wig 2 in place on the wearer with the wig clips 34 attached to the anchor braid 72.

Figure 7D:
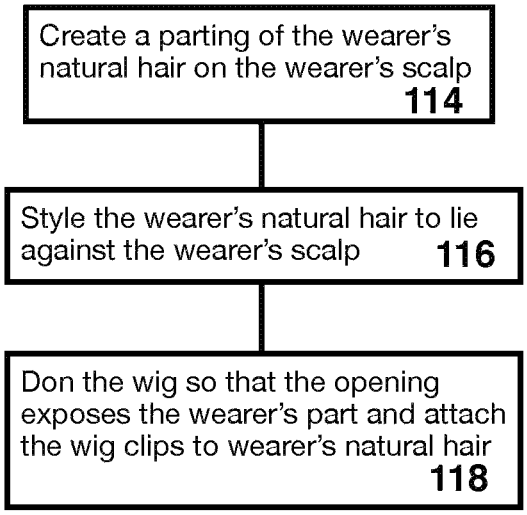
FIG. 7D is a flow chart of a fourth method of wearing the wig.
Figure 11:
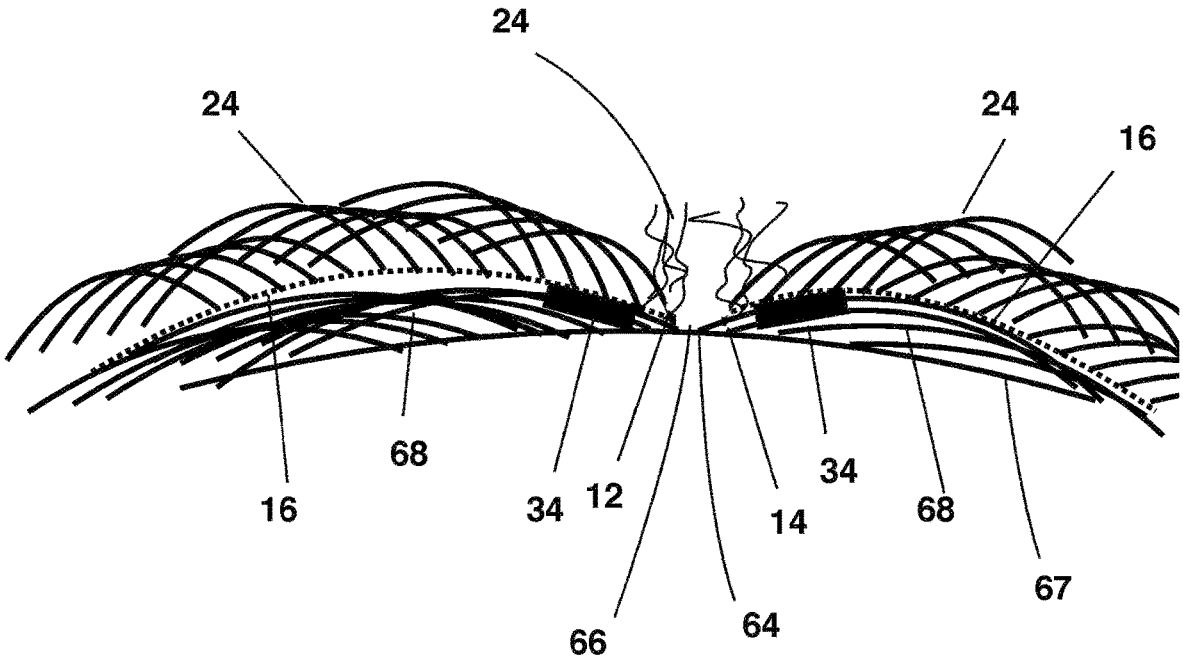
FIG. 11 is a schematic diagram of the wearer's part and the wig in relation to the part.

FIG. 7D and FIG. 11 illustrate a fourth method of preparing the wearer's hair 68 and attaching the wig 2 to the wearer's hair 68. From FIG. 7D, the wearer creates a part 64 in her natural hair 68 and styles her hair 68 to lie against the wearer's scalp 66. The wearer dons the wig 2, attaching the wig clips 34 to the wearer's natural hair 68 without the above steps of teasing or creating anchor braids 72. FIG. 11 shows the wig clips 34 attached to the wearer's hair 68 without teasing and without the anchor braid 72. This fourth method of preparing the wearer's hair 68 and installing the wig 2 is particularly useful for persons who have naturally coarse hair 68 roots that will retain the wig clip 34 without further preparation. The fourth method is also useful for a person who is demonstrating donning the wig 2, such as a social media influencer.

Figure 12:
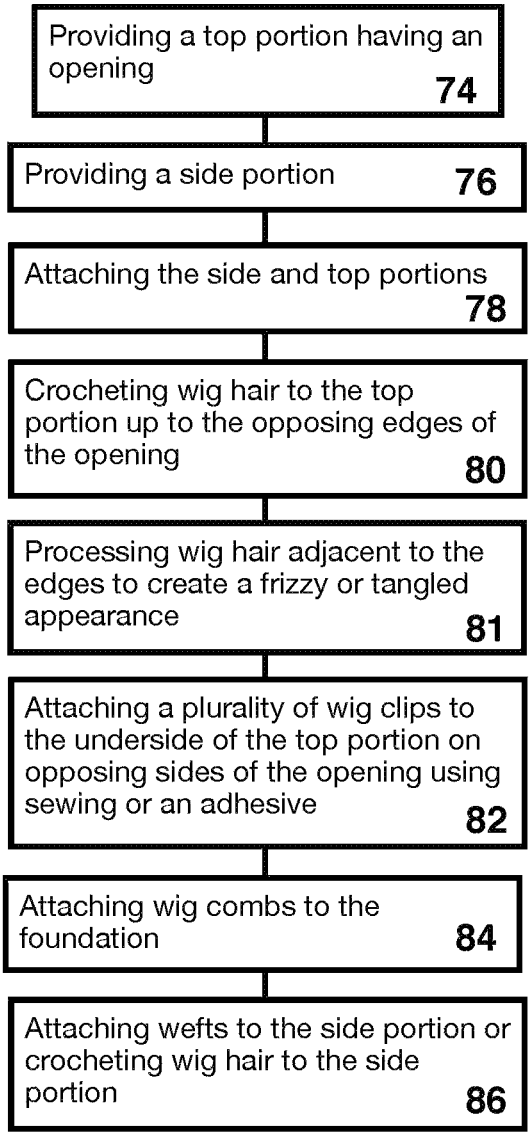
FIG. 12 is a flow chart of the first method for manufacturing the wig of the Invention.

FIG. 12 is a flow chart of a method of making the wig 2 of the Invention. In the method of FIG. 12, a manufacturer provides a top portion 8 (step 74) and a side portion 6 (step 76) and joins the top and side portions 8 and 6 to create foundation 4 (step 78). The top portion may include an opening 10, or an opening 10 may be cut or otherwise formed in the top portion 8 after it is assembled to the side portion 6. The manufacturer crochets wig hair 24 to the top portion 8 up to the edges 12, 14 of the opening 10 (step 80). The manufacturer processes the wig hair 24 at the edges 12, 14 of the opening 10 to create tangles of the wig hair 24 at the edges 12, 14 (step 81). The manufacturer attaches a plurality of wig clips 34 to the foundation 4, including on opposing edges 12 and 14 of the opening 10 (step 82). The manufacturer attaches wig combs 48 or other fasteners to the wig foundation 4 (step 84). The manufacturer attaches wefts 26 to the side portion 6, or crochets wig hairs 24 to the side portion 6, completing the wig 2. The above steps 74-86 may occur in an order different from that specified in FIG. 13 and as described above.

Figure 13A:
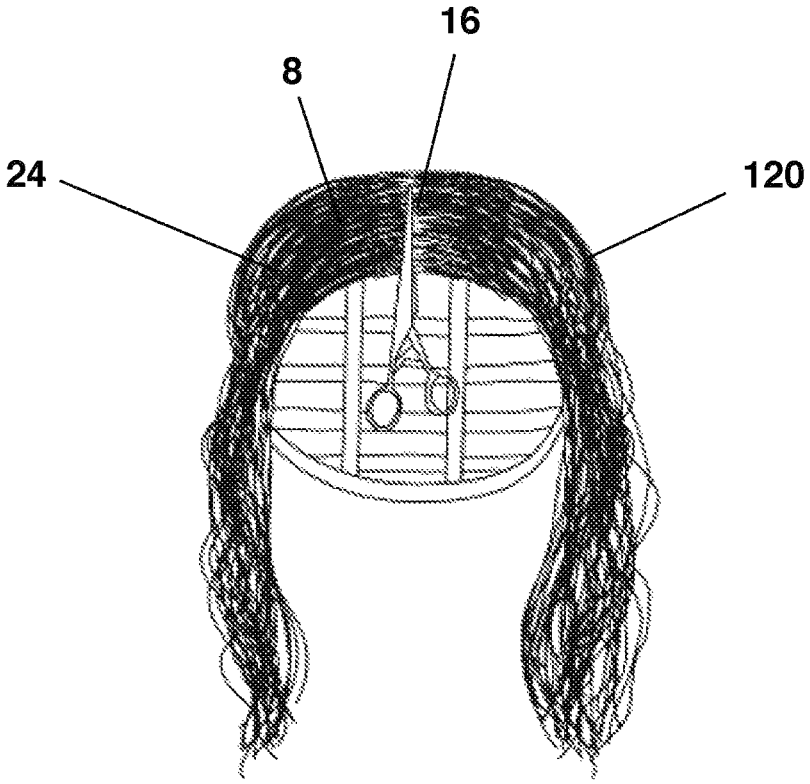
FIG. 13A shows cutting a completed wig to create an opening.
Figure 13B:
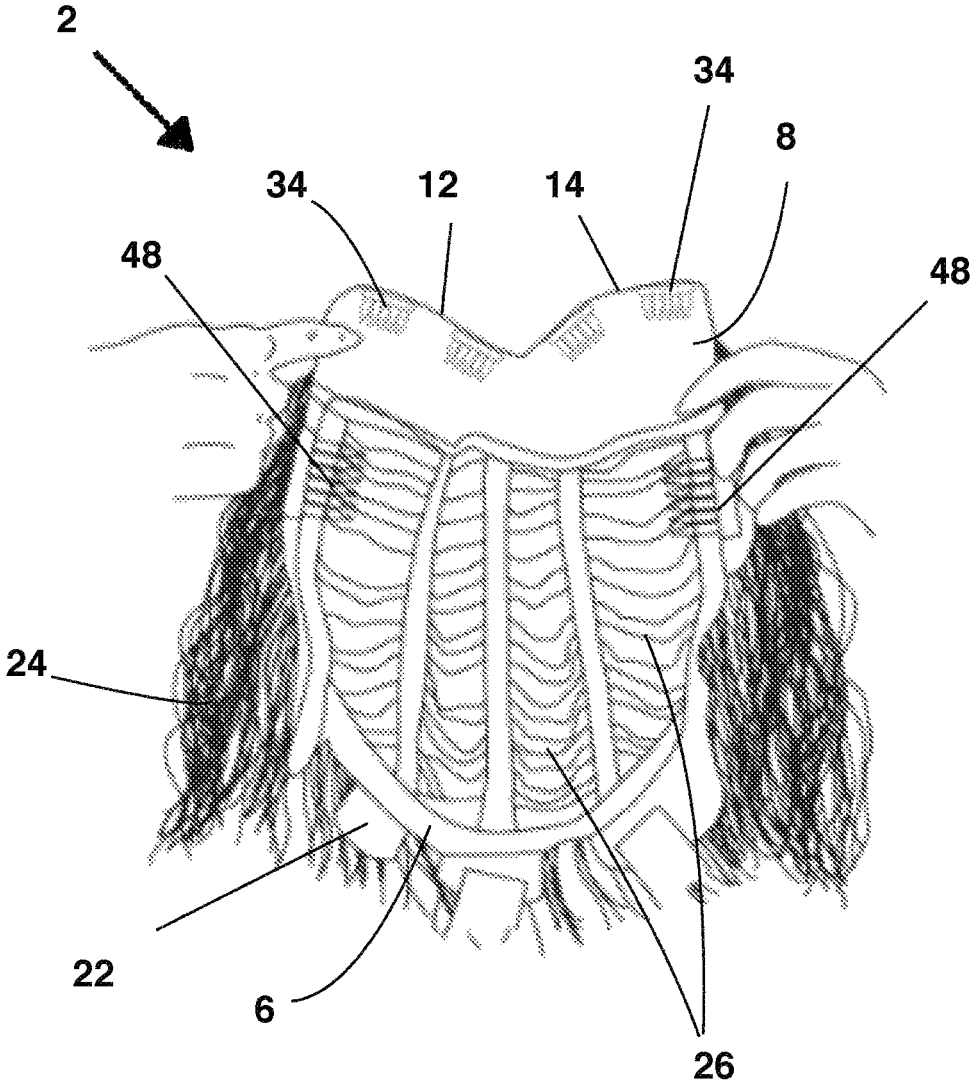
FIG. 13B is a view of the underside of the cut wig of FIG. 13A showing the wig clips.
Figure 14:
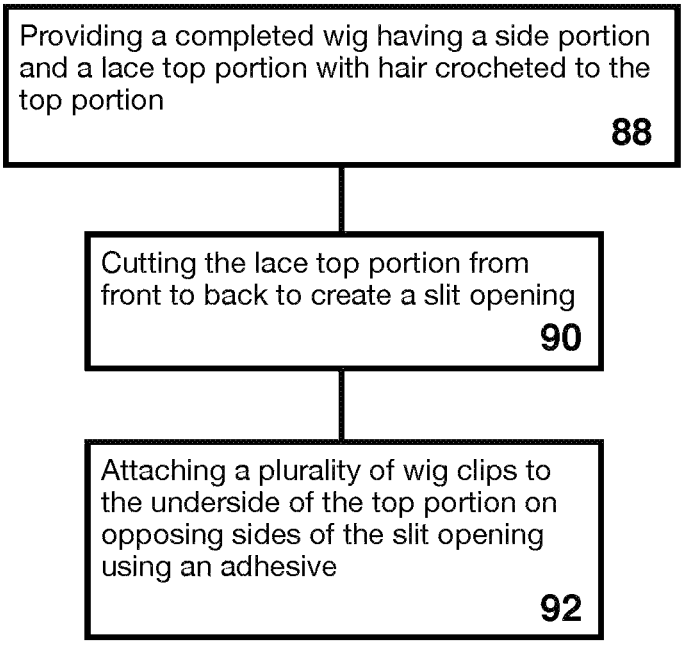
FIG. 14 is a flow chart of a method for manufacturing the wig of the Invention by modifying an existing wig.
Figure 15:
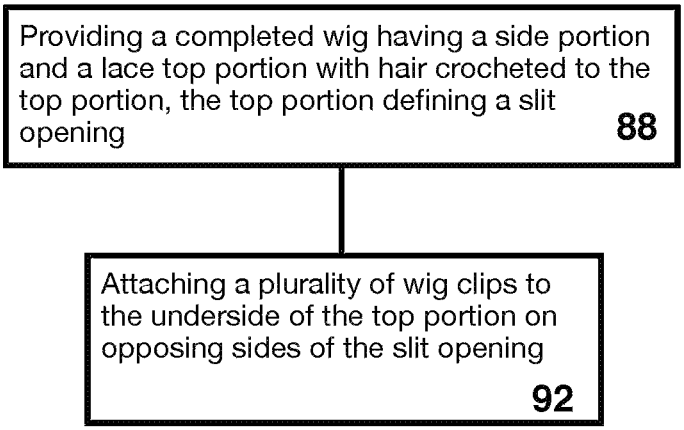
FIG. 15 is a flow chart of a method for manufacturing the wig by attaching wig clips to an existing wig.
Figure 16:
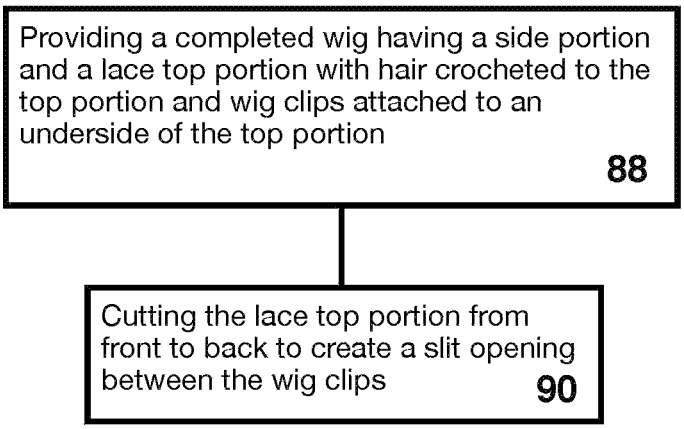
FIG. 16 is a flow chart of a method of manufacturing the wig by cutting an opening in an existing wig with wig clips installed.

FIGS. 13A and 13B and the flow charts of FIGS. 14, 15, and 16 illustrate the conversion of a completed wig 120, as defined herein, to be the wig 2 of the Invention. FIG. 14 is a flow chart of the first method of converting a completed wig 120 to wig 2 of the invention. In the method of FIG. 14 and as shown by FIG. 13A, the manufacturer starts with a completed wig 120 (step 88). The 'manufacturer' of FIG. 14 may be the wearer of the wig or maybe a person demonstrating the method of FIG. 14, such as a social media influencer, or maybe any other person. From FIG. 13A, the completed wig 120 has a top portion 8 composed of a fabric 16 and has wig hair 24 crocheted to the fabric 16. The completed wig 120 is ready for wear by a wearer but does not feature the opening 10, edges 12, 14, or wig clips 34 adjacent to the opposing edges 12, 14 of the wig 2 of the invention.

In step 90 of FIG. 14, fabric 16 is cut to define an opening 10, as with scissors, a knife, or a razor as shown by FIG. 13A. In step 92, and as shown by FIG. 13B, the manufacturer attaches wig clips 34 to the underside of the fabric 16 at the opposing edges 12, 14 of the opening 10 and separated from the edges 12, 14 by a separation distance to define the wig 2 of the Invention. The separation distance may be between 1 and 4 millimeters but preferably between 1.5 and 3 millimeters. The wig 2 of FIG. 13B shows four wig clips 34 and two wig combs 48; however, the actual wig 2 may have any number of wig clips 34 and wig combs 48. The wig 2 produced by the method of FIG. 14 is equivalent to the wig 2 of the invention described above with respect to FIG. 12.

FIG. 14 also addresses a person, such as a wig producer or social media influencer, who instructs a wearer on how to modify a completed wig to be a wig 2 of the Invention. The person may instruct a wearer to cut a completed wig 120 that does not have an opening 10, by scissors, a knife, or a razor, to define the opening 10 as described above. The person may instruct the wearer to attach wig clips 34 using an adhesive or by sewing to opposing boundaries 12, 14 of the opening 10.

From FIGS. 15 and 16, the 'completed wig' 120 may be provided to a wearer in a partially converted state, as by either providing the completed wig 120 with the opening 10 (FIG. 15) or with the wig clips 34 attached to the underside of the top portion 8 (FIG. 16), but not with both the opening 10 and the wig clips 34. The completion of the conversion to the wig 2 of the Invention by either cutting the opening 10 or by attaching the wig clips 34 to the fabric 16 of the top portion 8 is also contemplated by the Invention and by FIGS. 14, 15, and 16.

Figure 17:
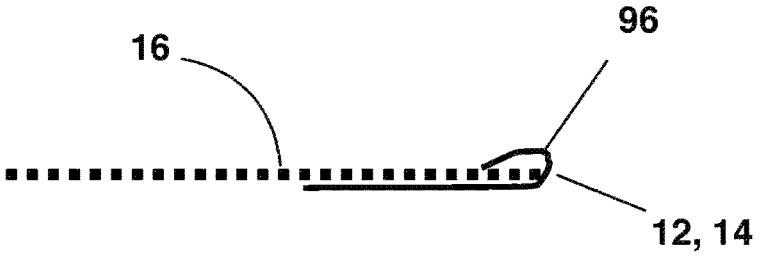
FIG. 17 is a first illustration of an under-fold of wig hair.
Figure 18:
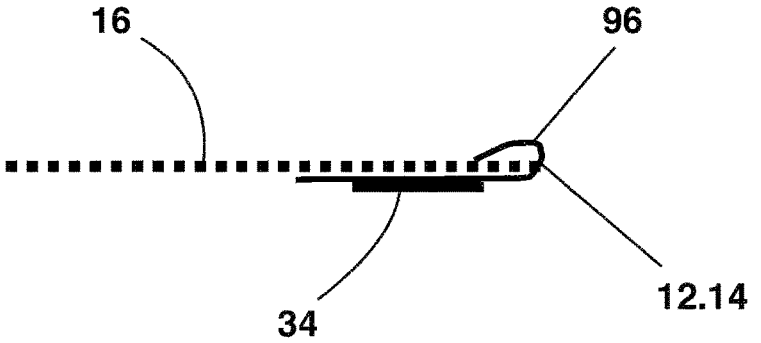
FIG. 18 is a second illustration of an under-fold of wig hair.
Figure 19:
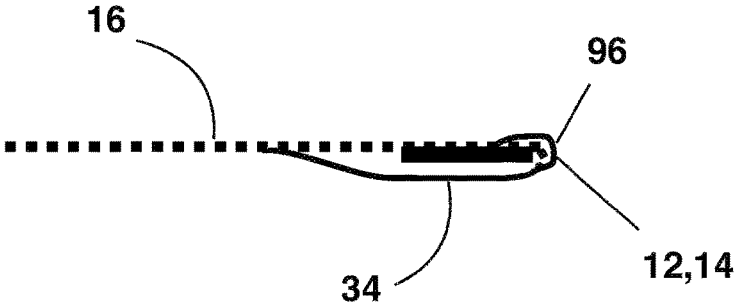
FIG. 19 is a third illustration of an under-fold of wig hair.

FIGS. 17, 18, and 19 illustrate a fold-under embodiment for wig 2 of the invention to hide the opposing edges 12, 14 of the opening 10. From FIG. 17, wig hairs 24 immediately adjacent to edges 12 and 14 are folded under edges 12 and 14. The wig hairs 24, which are now designated as 'fold-over wig hairs 96' are attached to the underside of the fabric 16, as by sewing or adhesive. From FIG. 18, as an option, the wig clips 34 may be installed to the underside of the fabric 16 with the fold-over wig hairs 96 disposed between the wig clip 34 and the underside of the fabric 16. From FIG. 19, the fabric 16 at the edge 12, 14 may be folded over the portion of the wig clip 34 immediately adjacent to the edge 12, 14. Because the wig clip 34 is attached close to the end of fabric 16, only a small amount of fabric 16, indicated by the dotted line, maybe wrapped about wig clip 34. The fold-over wig hair 96 is secured to the underside of the fabric 16, as by sewing or adhesive, with the wig clip 34 disposed between the fold-over wig hair 96 and the underside of the fabric 16. The fold-over wig hair 96 of FIG. 19 may be disposed between the teeth 36 of the wig clips 34 and may assist in retaining the wig clips 34 on the underside of the fabric 16 at the edge 12, 14. The fold-over wig hair 96 also may be attached to the fabric 16, as by sewing, proximal to the second end 40 of the wig clip 34 and distal to the edge 12, 14; that is, on the side of the wig clip 34 away from the edge 12, 14. Alternatively, the fold-over wig hair 96 may not be attached to the fabric 16 distal to the edge 12, 14 and the wearer or installer may tuck the fold-over wig hair 96 between the wig clip 34 and the wearer's natural hair 68 when the wearer dons the wig 2.

Figure 20:
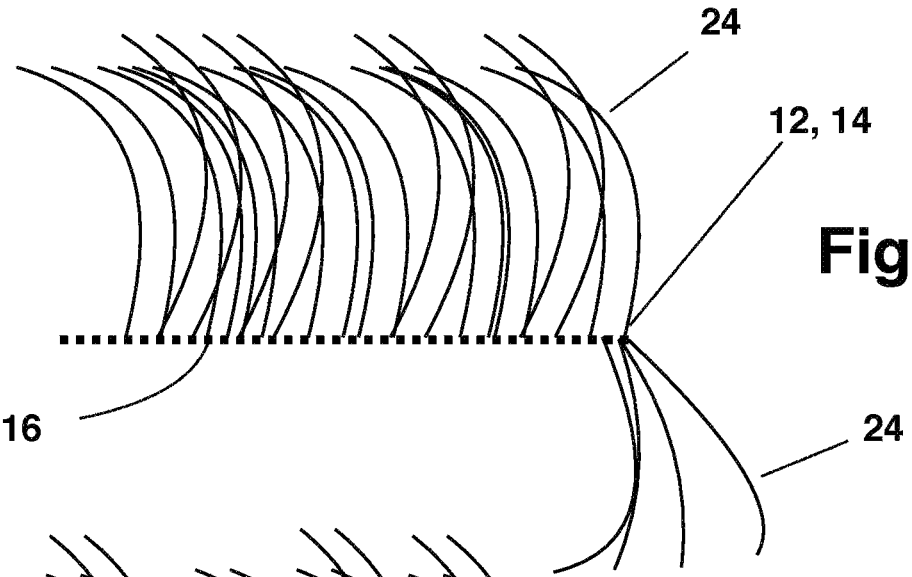
FIG. 20 is an illustration of wig hair on the underside of the fabric at the edge of the opening.

FIG. 20 shows an alternative configuration of the opposing edges 12, 14 of the fabric 16 at the opening 10. In the embodiment of FIG. 20, wig hairs 24 are crocheted to the top side of the fabric 16. Wig hairs 24 also are crocheted to the bottom side of the fabric 16 at the edges 12, 14. The wig hairs 24 attached to the bottom side of the fabric 16 help to hide the edges 12, 14 of the opening 10 when the wearer is wearing the wig 2.

Figure 21:
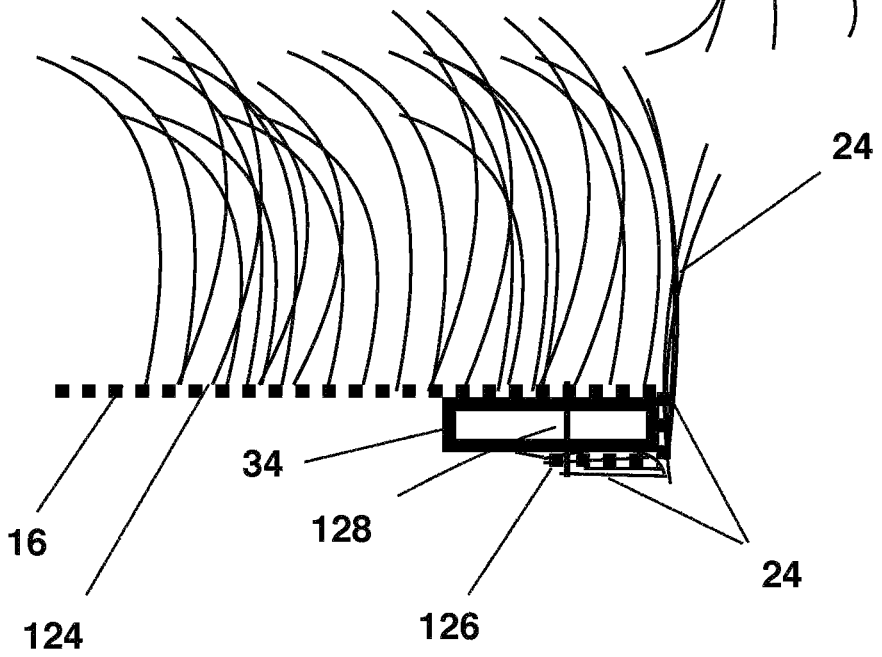
Fig. 21 prior art
FIG. 21 is a detailed schematic view of a prior art wig.

FIG. 21 shows a prior art wig by the inventor herein. In the prior art wig of FIG. 21, a fabric 16 of a top portion 8 defines a first portion 124 that conforms the wearer's head and a second portion 126 that is folded over the edge 12, 14 of an opening 10 and about wig clips 34. Wig clips 34 are shown in more detail in FIGS. 4 and 5. The prior art wig of FIG. 21 used wig clips 34 adjacent to the edges 12 and 14, and not wig combs 48, as those terms are used in the wig art. In the prior art wig, wig hair 24 was attached to both the first and the second portions 124, 126. The second portion 126 was approximately 0.5 inches in width and was sewn through the wig clip 34 to the first portion 124 by stitching 128. In the prior art wig, the stitching 128 passed between the teeth 36 of the wig clips 34. The combination of the second portion 126 and the wig hair 24 attached to the second portion 126, when sewn through the wig clip 34 to the first portion 124 created an excessively thick edge 12, 14 that suffered the same deficiencies as a prior art U-part wig; namely, the edge 12, 14 could not be located flush to the scalp, was not hidden and was readily visible. The stitching 128 and the wig hair 24 trapped by the stitching 128 also interfered with the operation of the two-position wig clips 34, causing the wig clips 34 to move to an open position from a closed position. The motion of the wig clips 34 in opening and closing as the wearer used the wig also caused the stitches 128 to loosen and fail over time. The method and wig 2 of the Invention correct the deficiencies of the prior art wig shown by FIG. 21.

Figure 22:
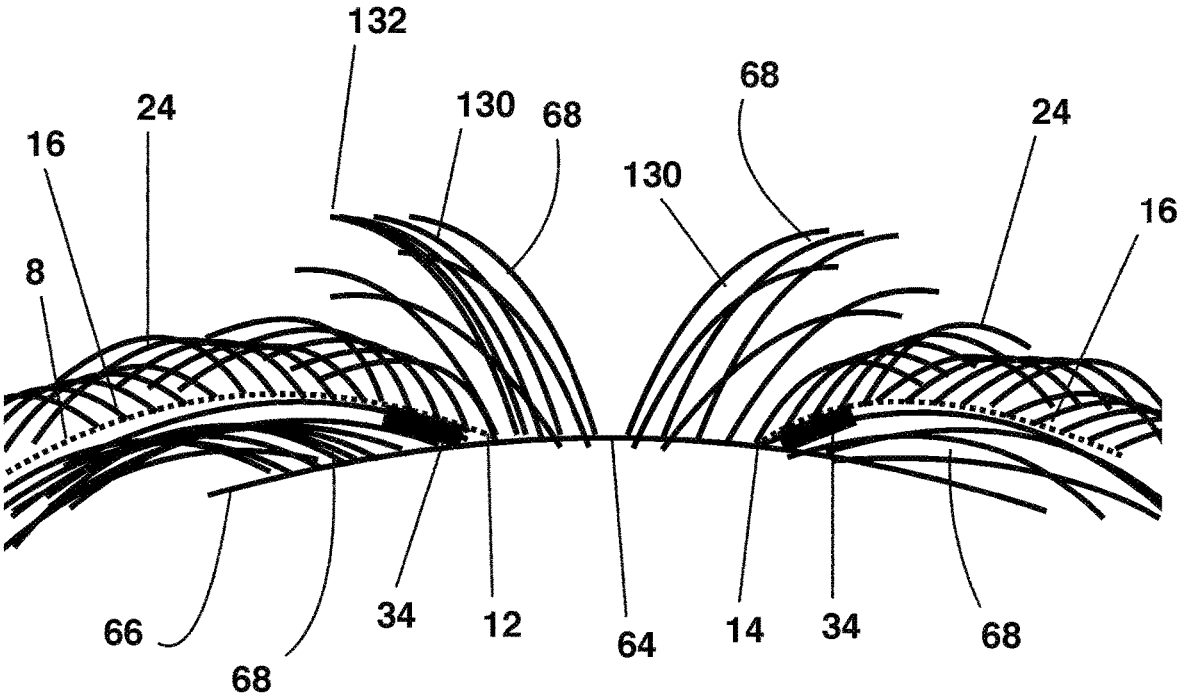
Fig. 22 prior art
FIG. 22 is a detailed schematic view of a second prior art wig installed on a wearer.

FIG. 22 illustrates a leave-out of a prior art U-part wig installed on the head of a wearer. In the U-part wig of FIG. 22, wig clips 34 attach the foundation 4 to anchor braids 72 created from the wearer's natural hair 68 in a spaced-apart relation to the wearer's natural part 64. Wig hair 24 is attached to wefts 26 that are attached to the foundation 4. The edges 12, 14 of the foundation 4 are not immediately adjacent to the natural part 64 and instead, the edges 12 and 14 may be separated by a distance of two to four inches. The wearer's natural hair 68 between the opposing edges 12, 14 is exposed and defines a leave-out 130 as defined herein. The ends 132 of the wearer's natural hair 68 defining the leave-out 130 are not covered by the wig 2 and instead are disposed over the wig hair 24 at the opposing edges 12, 14, allowing the leave-out 130 to hide the foundation 4 at the opposing edges 12, 14. The method and wig 2 of the Invention have the advantage over the prior art U-part wig in that a leave-out 130 is not required.

In this document and in the drawings, element names or numbers appearing in more than one drawing or more than one paragraph relate to the same or equivalent elements unless the context requires otherwise.

The following is a list of numbered elements in the specification and drawings.

Wig 2
Foundation 4
Side portion 6
Top portion 8
Opening 10
Opposing edges 12, 14
Fabric 16
Single layer 18
Lace 20
Tabs 22
Wig hair 24
Weft 26

Weft substrate 28
Crocheted hairs 30
Underside of the top portion 32
Wig clip 34
Teeth 36
First end 38
Second end 40
Adhesive 42
Thread 44
Separation distance 46
Wig comb 48
Create parting 50
Segregate first portion 52
Tease first portion 54
Segregate second portion 56
Tease second portion 58
Secure wearer's hair against the wearer's scalp 60
Attach wig clips to the tangles 62
Wearer's natural part 64
Wearer's natural scalp 66
Wearer's natural hair 68
Anchor braid 72
Providing a top portion having an opening 74
Providing a side portion 76
Attaching the top and side portions 78
Crocheting hair to the top portion 80
Attaching wig clips to the opposing boundaries of the opening 82
Attaching wig combs to the foundation 84
Attaching wefts to the side portion 86
Providing a completed wig 88
Cutting the top portion to define the opening 90
Attaching wig clips to the top portion 92
Flap 94
Fold-under wig hair 96
Creating a parting 98
Creating an anchor braid 100
Style wearers other hair 102
Don the wig and attach the wig clips between the part and the anchor braid 104
Creating a parting 106
Create an anchor braid 108
Style wearer's other hair 110
Don the wig and attach the wig clips to the anchor braid 112
Create a parting 114
Style wearer's hair 116
Don the wig and attach wig clips to wearer's natural hair 118
Completed wig 120
Prior art wig 122
First portion 124
Second portion 126
Stitching 128
Leave-out 130
Ends of the wearer's natural hair 132

While the foregoing written description of the invention enables one of ordinary skill to make and use what is considered presently to be the best mode thereof, those of ordinary skill will understand and appreciate the existence of variations, combinations, and equivalents of the specific embodiment, method, and examples herein. The invention should therefore not be limited by the above-described embodiment, method, and examples, but by all embodiments and methods within the scope and spirit of the invention as claimed.

What is claimed is:

1. A wig comprising:

a top portion configured to cover a top of a head of a wearer of the wig, the top portion has a front side and a rear side, the top portion narrows down from the front side towards the rear side, the front side is broad, and the rear side is narrow;

an elongated cut in the top portion traverses from the front side towards and near the rear side, the elongated cut has a left edge and a right edge, wherein the left edge and the right edge are unfinished and un-reinforced, wherein wig hairs along the left edge and the right edge are profiled same as the wig hairs in a rest of the top portion, wherein said top portion is unfinished and un-reinforced;

a plurality of wig clips disposed in proximity to and substantially parallel to the left edge and the right edge of the elongated cut on an underside of the top portion, the plurality of wig clips configured to secure the top portion of the wig to hairs to the wearer;

a first strap having a proximal end and a distal end, the proximal end of the first strap coupled to a left corner of the front side and the distal end coupled to a right corner of the front side;

a rear strap extends between the rear side of the top portion and a rear of the first strap; and a pair of side straps that extend between opposite sides of the top portion and opposite sides of the first strap, wherein the top portion is made of fabric, the fabric is of a color same as a color of wig hairs, the wig hairs extend from the top portion.

2. The wig of claim 1, wherein the opposite sides and the rear sides are continuous forming a U-shape, wherein a width of the U-shape elongated cut corresponds to a width of wearer's part, wherein when the wig is worn by the wearer, natural hairs of the wearer along the left edge and the right edge are not exposed.

3. The wig of claim 1, wherein the wig further comprises a plurality of tabs that extends from the first strap, the plurality of tabs are spaced apart from each other.

4. The wig of claim 1, wherein the fabric is made of lace, and the elongated cut is in the fabric.

5. The wig of claim 1, wherein a substrate is coupled to the first strap and an adjacent side strap of the pair of side straps, wherein wig hairs extend from the substrate.

6. The wig of claim 1, wherein wig hairs along the left edge and the right edge are tied/crochet and profiled different as the wig hairs in a rest of the top portion being Wefted hair.

7. A wig, the wig comprising:

a foundation, the foundation defining a side portion and a top portion, the side portion being configured to conform to the sides of the head of a wearer, the top portion being composed of a fabric, the top portion being configured to conform to the top of the head of the wearer, the fabric defining an opening communicating through the fabric, the fabric defining a pair of opposing edges of the opening, wherein the pair of opposing edges are unfinished and un-reinforced;

a plurality of wig clips, each of the wig clips being attached at a corresponding edge on an underside of the top portion; and wig hairs attached to the top portion at the opposing edges, wherein wig hairs along the pair of opposing edges are profiled differently from wig hairs in a rest of the top portion, a color of the fabric is same as a color of the wig hairs, wherein the fabric defines a first portion, the fabric not defining a second portion that is folded over the wig clips and sewn to the first portion through the wig clips.

8. The wig of claim 7 wherein the wig hair and the fabric are black in color.

9. The wig of claim 7 wherein the wig hairs are human hairs or synthetic hairs that are coupled to the top portion through knots.

10. The wig of claim 7 wherein each of the wig clips is attached between 1 millimeter and 4 millimeters from the corresponding edge.

11. The wig of claim 7 wherein the top portion and the opposing edges are composed of a single layer of the fabric.

12. The wig of claim 11 wherein the fabric defines a synthetic net having a thickness of 0.35 to 0.45 millimeters and defining net openings of 0.3 to 1.5 millimeters.

13. The wig of claim 7 wherein the wig hairs along the opposing edges are profiled to be tangled in order to hide the edges of the fabric.

14. The wig of claim 7 wherein the wig includes a plurality of under-folded wig hairs, each of the under-folded wig hairs having a first end that is attached to a top side of the top portion at a corresponding edge of the fabric, each of the under-folded wig hairs extending around the corresponding edge to the underside of the top portion, each of the under-folded wig hairs having a second end that is attached to the underside of the top portion.

15. The wig of claim 14 wherein each of the wig clips is disposed between the under-folded wig hair and the underside of the top portion, each of the wig clips having a wig clip first end and an opposing wig clip second end, the wig clip first end being disposed adjacent to one of the opposing edges, each of the wig clips defining hair engaging teeth, the teeth emerging from each of the wig clips at a location adjacent to the wig clip first end, the second end of the under-folded wig hairs being attached to the underside of the top portion proximal to the wig clip second end and distal to the wig clip first end.

16. The wig of claim 7 wherein the wig hairs along the opposing edges extend from the underside to the top of the fabric.

* * * * *